US007857388B2

(12) United States Patent
Bedford et al.

(10) Patent No.: US 7,857,388 B2
(45) Date of Patent: Dec. 28, 2010

(54) SEATING UNIT WITH ADJUSTABLE LUMBAR DEVICE

(75) Inventors: Adam C. Bedford, Rockford, MI (US); Gordon J. Peterson, Rockford, MI (US); Gary Lee Karsten, Wayland, MI (US); Robert J. Battey, Middleville, MI (US); Jeffrey A. Hall, Grand Rapids, MI (US)

(73) Assignee: Steelcase Inc., Grand Rapids, MI (US)

( * ) Notice: Subject to any disclaimer, the term of this patent is extended or adjusted under 35 U.S.C. 154(b) by 430 days.

(21) Appl. No.: 11/757,138

(22) Filed: Jun. 1, 2007

(65) Prior Publication Data

US 2008/0296945 A1 Dec. 4, 2008

(51) Int. Cl.
*A47C 3/00* (2006.01)
*A47C 7/14* (2006.01)

(52) U.S. Cl. ..... 297/284.7; 297/284.2; 297/284.4

(58) Field of Classification Search ..... 297/284.1, 297/284.4, 284.7
See application file for complete search history.

(56) References Cited

U.S. PATENT DOCUMENTS

| | | | |
|---|---|---|---|
| 538,708 | A | 5/1895 | Smith |
| 614,997 | A | 11/1898 | Smith |
| 767,099 | A | 8/1904 | Bertolett |
| 856,058 | A | 6/1907 | Hanger |
| 1,001,312 | A | 8/1911 | Sebring |
| 1,228,771 | A | 6/1917 | Hanger |
| 1,338,211 | A | 4/1920 | Clarke |
| 1,375,868 | A | 4/1921 | Thompson |
| 1,789,821 | A | 1/1931 | Leffingwell |
| 2,620,861 | A | 12/1952 | Oothoudt |
| 2,843,195 | A | 7/1958 | Barvaeus |
| 3,203,734 | A | 8/1965 | Seymer |
| 3,734,561 | A | 5/1973 | Barecki et al. |

(Continued)

FOREIGN PATENT DOCUMENTS

| | | | |
|---|---|---|---|
| DE | 3521067 | A1 | 12/1985 |

(Continued)

*Primary Examiner*—David Dunn
*Assistant Examiner*—Erika Garrett
(74) *Attorney, Agent, or Firm*—Price, Heneveld, Cooper, DeWitt & Litton, LLP

(57) ABSTRACT

A chair includes a lower back frame, a back construction, including a back support attached to the lower back frame, a cushion assembly attached to the back support, and a vertically adjustable lumbar frame positioned between the back support and the cushion assembly. The lumbar frame includes a transition shell and a vertically sliding lumbar device having a plurality of horizontal flexible wires. A lower edge of the transition shell is positioned on top of an uppermost horizontal flexible wire of the lumbar device. The lumbar device is operably slidably mounted between the outer shell and cushion assembly and the transition shell upper edge slides between the outer shell and the upholstery cushion assembly. Also disclosed is a chair including a Y-shaped lower back frame having two uprights and a cross-piece attached to the back support. The uprights and cross-piece of the lower back frame include an overlap flange and the back support includes a channel-shaped flange having detents. The overlap flange and channel-shaped flange mate to form an overlap joint, including a box beam for added structural support.

13 Claims, 22 Drawing Sheets

U.S. PATENT DOCUMENTS 3,907,363 A 9/1975 Baker et al.
3,947,068 A 3/1976 Buhk
4,350,388 A 9/1982 Weiner
4,502,728 A 3/1985 Sheldon et al.
4,529,247 A 7/1985 Stumpf et al.
4,541,670 A 9/1985 Morgenstern et al.
4,634,176 A 1/1987 Scott
4,634,178 A 1/1987 Carney
4,660,887 A 4/1987 Fleming et al.
4,722,569 A 2/1988 Morgenstern et al.
4,730,871 A 3/1988 Sheldon
4,805,962 A 2/1989 Sacco et al.
4,810,033 A 3/1989 Kemmann
4,892,356 A 1/1990 Pittman et al.
4,915,448 A 4/1990 Morgenstern
4,962,964 A 10/1990 Snodgrass
5,015,038 A 5/1991 Mortz, III
5,018,788 A 5/1991 Cedergreen
D319,739 S 9/1991 Narita
5,044,693 A 9/1991 Yokota
D322,363 S 12/1991 Narita
5,100,204 A 3/1992 Makihara et al.
5,112,106 A 5/1992 Asbjornsen et al.
5,286,083 A 2/1994 Mattison
5,328,245 A 7/1994 Marks et al.
5,338,099 A 8/1994 Ishi et al.
5,460,427 A 10/1995 Serber
5,567,010 A 10/1996 Sparks
5,641,205 A 6/1997 Schmidt
5,651,584 A 7/1997 Chenot et al.
5,678,893 A 10/1997 Bock
5,711,575 A 1/1998 Hand et al.
5,752,741 A 5/1998 Bort
5,791,733 A * 8/1998 van Hekken et al. ..... 297/284.4
5,820,221 A 10/1998 Greaves et al.
D407,576 S 4/1999 Rich et al.
5,902,011 A 5/1999 Hand et al.
5,951,110 A 9/1999 Conner et al.
5,975,632 A * 11/1999 Ginat ..... 297/284.7
6,013,040 A 1/2000 Morgenstern et al.
6,033,027 A 3/2000 Conner et al.
6,035,901 A 3/2000 Stumpf et al.
6,042,187 A 3/2000 Conner et al.
6,059,362 A 5/2000 Lin
6,059,368 A 5/2000 Stumpf et al.
6,062,649 A 5/2000 Nagel et al.
6,079,785 A 6/2000 Peterson et al.
6,099,076 A 8/2000 Nagel et al.
6,125,521 A 10/2000 Stumpf et al.
6,149,236 A 11/2000 Bräuning
6,168,239 B1 1/2001 Conner et al.
6,186,594 B1 2/2001 Valiquette et al.
6,189,972 B1 2/2001 Chu et al.
6,220,661 B1 * 4/2001 Peterson ..... 297/218.4
6,224,160 B1 5/2001 Takeuchi
6,260,921 B1 7/2001 Chu et al.
6,354,662 B1 3/2002 Su
6,378,942 B1 4/2002 Chu
6,382,719 B1 5/2002 Heidmann et al.
6,386,634 B1 5/2002 Stumpf et al.
6,394,545 B2 5/2002 Knoblock et al.
6,394,546 B1 5/2002 Knoblock et al.
6,409,268 B1 6/2002 Cvek
6,419,318 B1 * 7/2002 Albright ..... 297/284.7
6,425,637 B1 7/2002 Peterson
6,471,294 B1 10/2002 Dammermann et al.
6,523,898 B1 2/2003 Ball et al.
6,550,866 B1 * 4/2003 Su ..... 297/452.42
6,572,190 B2 6/2003 Koepke et al.
6,575,530 B1 6/2003 Fischer et al.
6,588,842 B2 7/2003 Stumpf et al.
6,626,497 B2 9/2003 Nagamitsu et al.
6,688,687 B2 2/2004 Chu
6,688,690 B2 * 2/2004 Watson et al. ..... 297/316
6,695,403 B1 2/2004 Su
6,702,390 B2 3/2004 Stumpf et al.
6,722,741 B2 4/2004 Stumpf et al.
6,726,286 B2 4/2004 Stumpf et al.
6,733,080 B2 5/2004 Stumpf et al.
6,755,467 B1 6/2004 Chu
D495,509 S 9/2004 Breen
D496,812 S 10/2004 Chu
6,817,667 B2 11/2004 Penningtom et al.
6,843,530 B1 * 1/2005 Wu ..... 297/284.4
6,848,744 B1 2/2005 Raftery et al.
6,874,852 B2 4/2005 Footitt
D506,628 S 6/2005 Koepke et al.
D506,629 S 6/2005 Koepke et al.
6,908,159 B2 6/2005 Prince et al.
6,910,741 B2 * 6/2005 Footitt ..... 297/452.29
D507,437 S 7/2005 Klaasen et al.
6,913,315 B2 7/2005 Ball et al.
D509,388 S 9/2005 Koepke et al.
6,938,956 B1 9/2005 Piretti
6,957,861 B1 10/2005 Chou et al.
6,966,604 B2 11/2005 Stumpf et al.
6,969,116 B2 11/2005 Machael et al.
D512,843 S 12/2005 Breen
6,971,717 B1 12/2005 Rhodes
6,974,189 B2 12/2005 Machael et al.
6,981,743 B2 1/2006 Edwards et al.
6,994,400 B2 2/2006 Koepke et al.
7,063,384 B2 6/2006 Liu
7,066,538 B2 6/2006 Machael et al.
7,066,546 B2 6/2006 Trego et al.
7,097,247 B2 * 8/2006 Battey et al. ..... 297/284.4
7,104,604 B1 9/2006 Kang
2002/0093233 A1 7/2002 Chu
2002/0096920 A1 7/2002 Watson et al.
2003/0111886 A1 6/2003 Footitt
2004/0245825 A1 * 12/2004 Battey et al. ..... 297/284.4
2004/0245839 A1 12/2004 Bodnar et al.
2004/0245841 A1 12/2004 Peterson et al.
2005/0035638 A1 2/2005 Pennington et al.
2005/0062323 A1 3/2005 Dicks
2005/0146195 A1 7/2005 Machael et al.
2005/0189810 A1 9/2005 Wu
2006/0103222 A1 5/2006 Caruso et al.
2006/0181127 A1 8/2006 Pennington et al.

FOREIGN PATENT DOCUMENTS

DE 4236631 A1 5/1994
FR 767099 7/1934
FR 1338211 11/1962
GB 149246 4/1921
GB 342613 2/1931
GB 483047 4/1938
GB 640883 8/1950
KR 20-0250543 Y1 11/2001
WO 2006010552 2/2006
WO 2006119209 11/2006

* cited by examiner

SEATING UNIT WITH ADJUSTABLE LUMBAR DEVICE

CROSS-REFERENCE TO RELATED APPLICATIONS

This application is related to co-assigned, co-pending application Ser. No. 11/757,187, filed on even date herewith, entitled HEIGHT ADJUSTABLE ARMREST, and also related to co-assigned, co-pending application Ser. No. 11/757,169, filed one even data herewith, entitled CHAIR BACK ATTACHMENT AND METHOD OF ASSEMBLY, the entire contents of both of which are incorporated herein by reference.

BACKGROUND OF THE INVENTION

The present invention relates to a chair incorporating an adjustable lumbar assembly and device and an overlap joint connection. More particularly, the present invention relates to a chair having a back support, an upholstery cushion assembly and a vertically adjustable, flexible live back lumbar assembly and device positioned therebetween and a chair back support connected to a lower frame having an overlap joint connection.

Chair users and seating manufacturers have recognized the value and health benefit of providing good adjustable lumbar support. However, new lumbar devices are desired which provide optimal comfort, but are simple to manufacture and assemble, are easily adjustable, operate smoothly, and are durable and robust. A lumbar device is desired that slides more fluidly and smoothly between adjusted positions, yet is secure in its selected position and effective in its function.

Accordingly, an adjustable lumbar assembly and device are desired that solves the aforementioned problems and that has the aforementioned advantages.

SUMMARY OF THE INVENTION

In one aspect of the present invention, a chair back construction includes an outer shell, a lumbar assembly positioned over the outer shell, and a cushion assembly positioned over the lumbar assembly and attached to the outer shell. The lumbar assembly includes a lumbar frame including a transition shell having an upper edge and a lower edge, and a vertically sliding live lumbar device having a plurality of horizontal flexible wires, where the transition shell lower edge is positioned on top of an uppermost horizontal flexible wire of the lumbar device. The lumbar device is operably slidably mounted between the outer shell and cushion assembly and the transition shell upper edge slides between the outer shell and the upholstery cushion assembly.

In another aspect of the present invention, a lumbar device is provided which includes a pair of wire retainers and a plurality of flexible wires. Each retainer includes a convex front surface which has a plurality of wells, an outside surface including oppositional tabs for slidably engaging a wave ridge of a back support to hold the lumbar device in a selected position, and a rear surface which is shaped to slidably engage a front surface of the back support. The plurality of flexible wires are positioned in the wire retainer wells and held in a horizontal position and form a curved surface which pushes in the direction of the cushion assembly to provide live lumbar support.

In yet another aspect of the present invention, a chair includes a lower back frame having two uprights and a cross-piece where the uprights and cross-piece each include an overlap flange. The chair also includes a back construction having a back support attached to the lower back frame. The back support includes two sides and a bottom where the sides and bottom each include a channel-shaped flange. The overlap flanges of the uprights and cross-piece and the channel-shaped flanges of the back support mate to form a U-shaped overlapped joint.

In another aspect of the present, invention, a chair includes a lower back frame having two uprights and a cross-piece, where the uprights each include an overlap flange. The chair also includes a back, support attached to the lower back frame, where the back support has two sides each including a channel-shaped flange having detents. The overlap flange of the uprights and the channel-shaped flanges mate to form a box beam on each side.

These and other aspects, objects and features of the present invention will be understood and appreciated by those skilled in the art upon studying the following specification, claims, and appended drawings.

BRIEF DESCRIPTION OP THE DRAWINGS

FIG. 37 showing the aperture and hook spread apart, and FIG. 38 showing the hook and aperture together;

DETAILED DESCRIPTION OF PREFERRED EMBODIMENT

Figure 2:
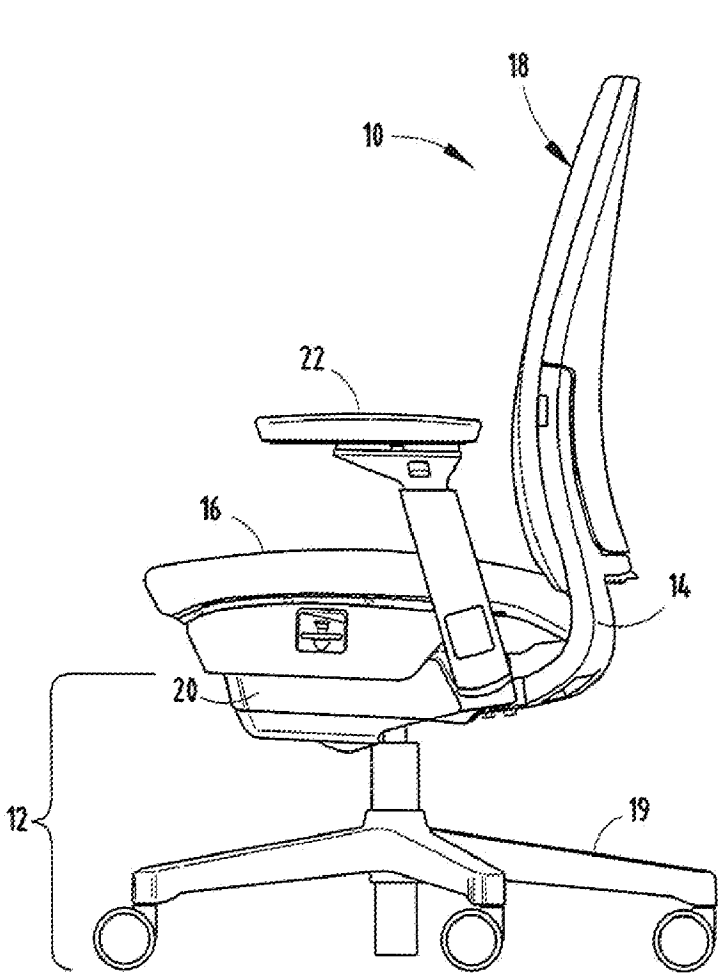
FIG. 2 is a left side elevational view of the chair shown in FIG. 1.
Figure 1:
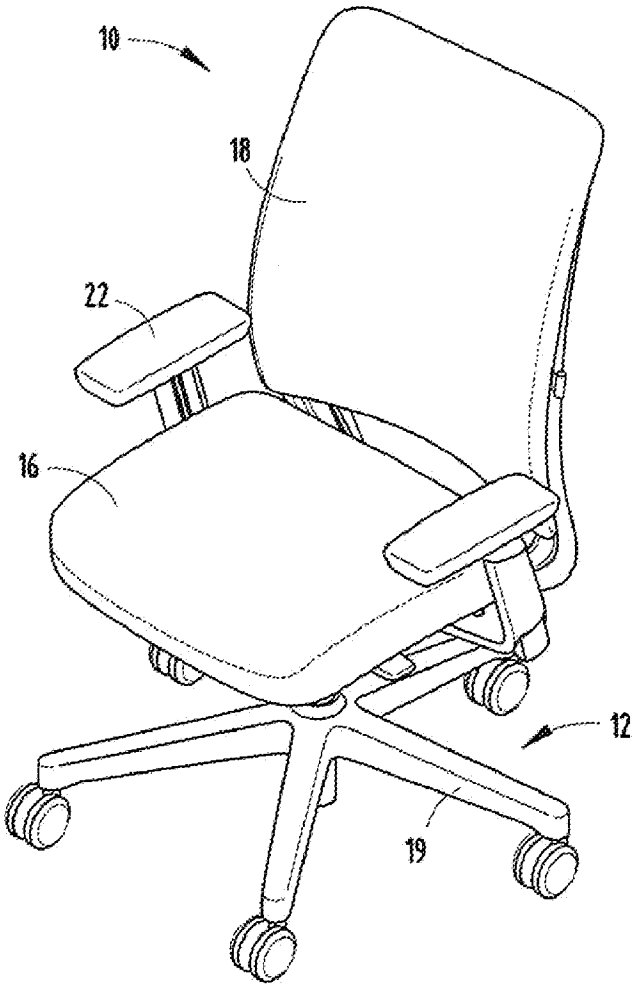
FIG. 1 is a top perspective view of a chair embodying the present invention.
Figure 4:
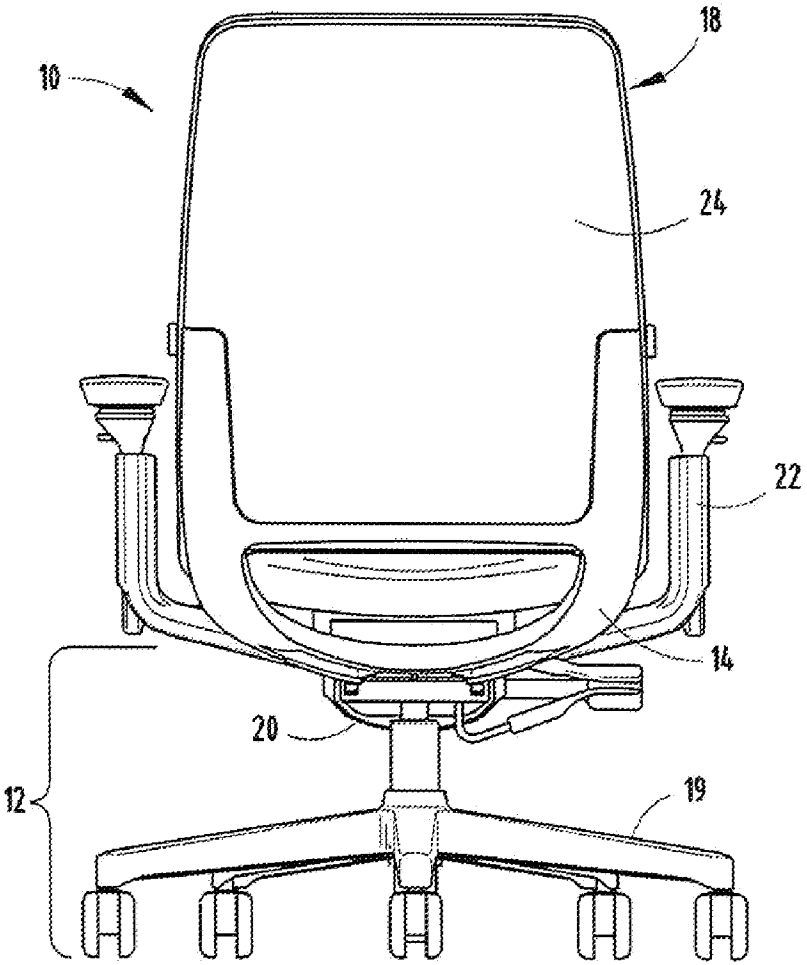
FIG. 4 is a rear elevational view of the chair shown in FIG. 1.
Figure 3:
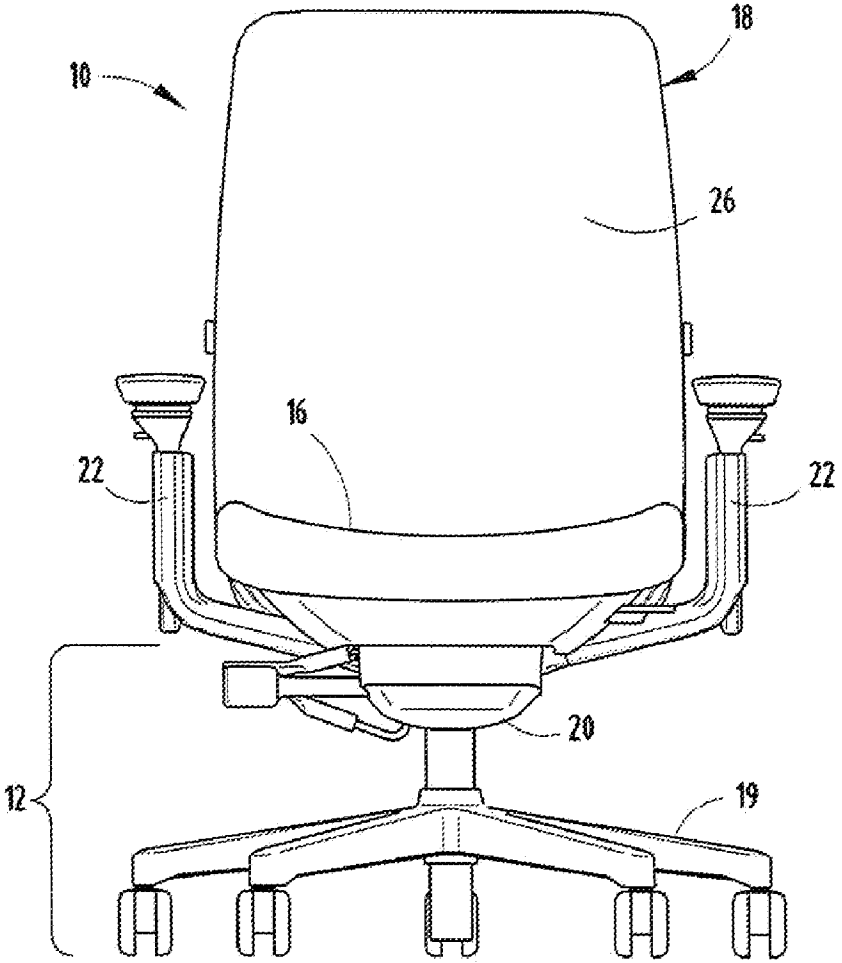
FIG. 3 is a front elevational view of the chair shown in FIG. 1.

For purposes of description herein, the terms "upper," "lower," "rear," "front," "vertical," "horizontal," and derivatives thereof shall relate to the invention as oriented in FIG. 1. The terms "right" and "left" shall relate to the invention as oriented relative to a person in a seated position. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 5:
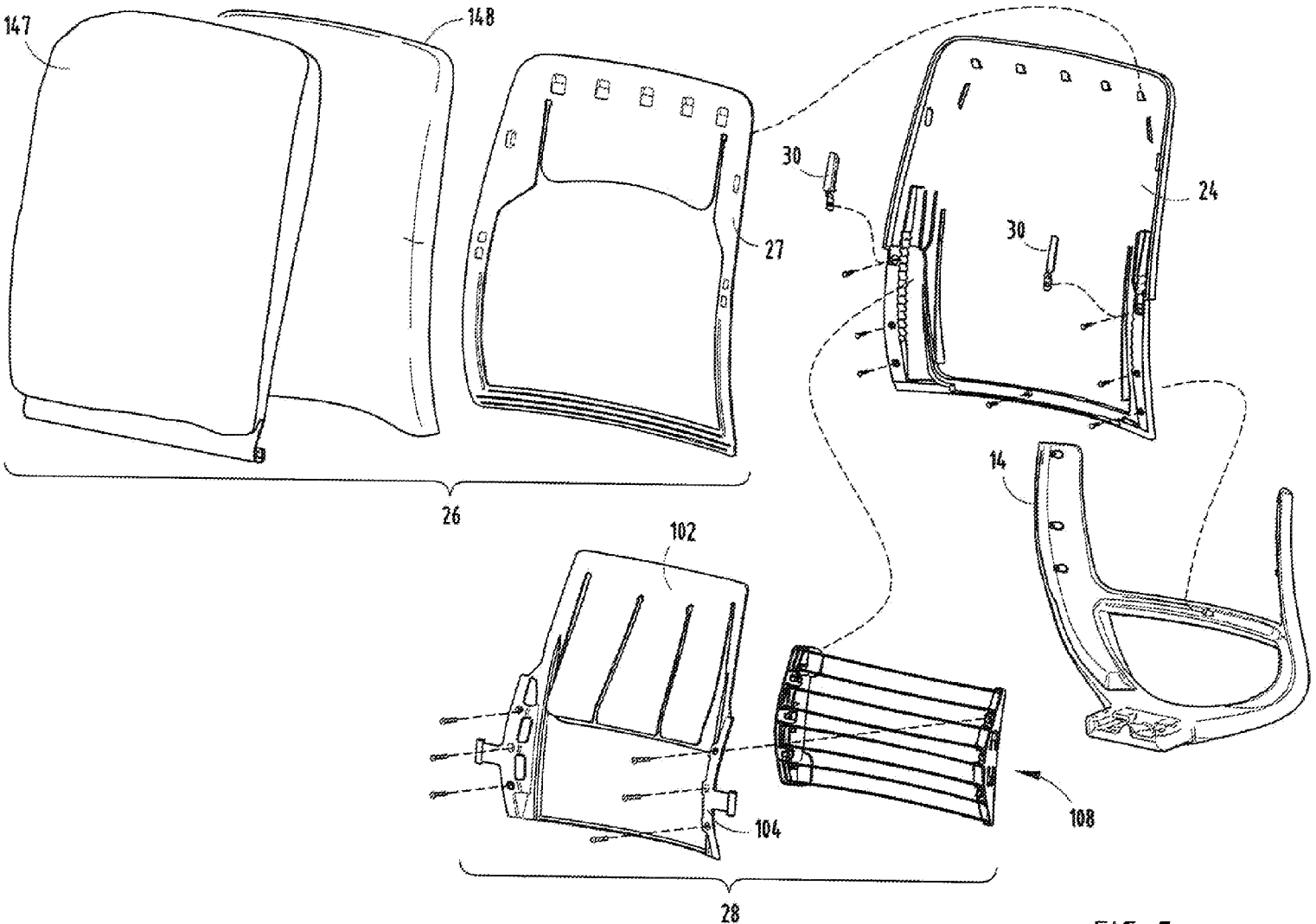
FIG. 5 is an exploded view of the back construction and lower back frame of the chair in FIG. 1.
Figure 7:
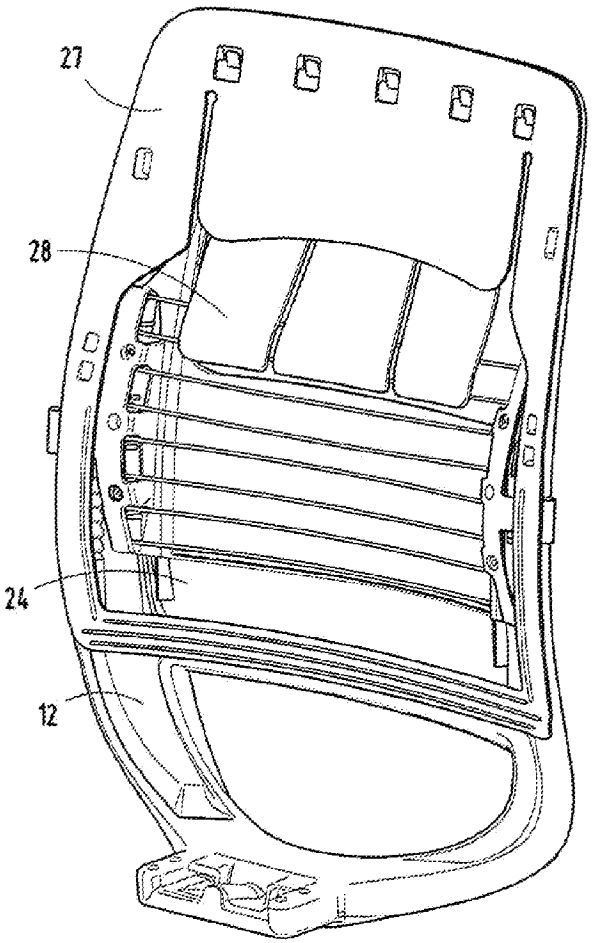
FIG. 7 is a top perspective view of the lower back frame and back construction in FIG. 6.
Figure 6:
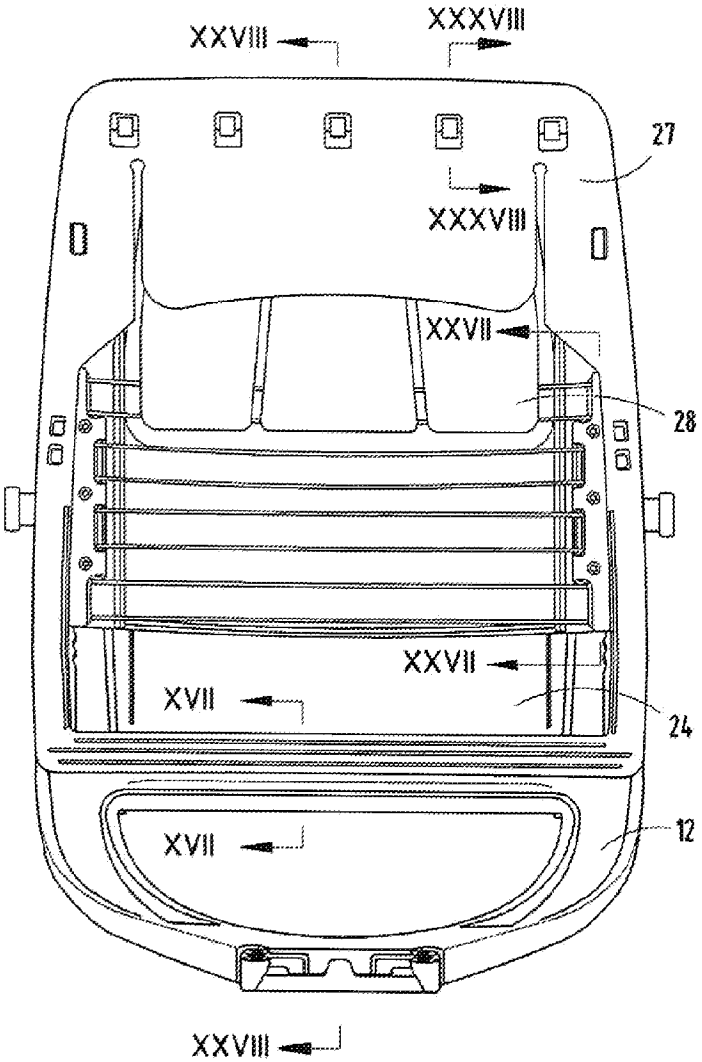
FIG. 6 is a front elevational view of a lower back frame connected to a back construction without a cushion assembly, but including a back support, a lumbar assembly, and an inner shell.
Figure 45:
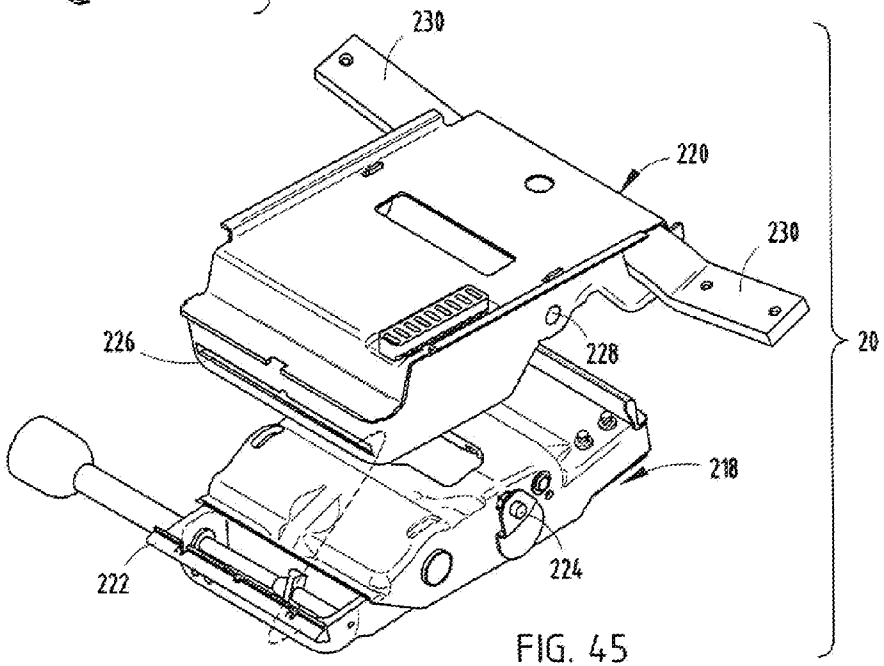
FIG. 45 is an exploded top perspective view of the control housing in FIG. 44.

As illustrated in FIGS. 1-4, one embodiment of a chair 10 of the present invention includes a base 12, a lower back frame 14, a seat 16, and a back construction 18. The base 12 includes a leg assembly 19 and a control housing 20 attached to the leg assembly 19. The control housing 20 includes a fixed support structure 230 which extends laterally and upwardly on either side of the control housing (FIG. 45). An armrest 22 is attached to each side of the support structure. The seat 16 is attached to the control housing 20. The lower back frame 14 is attached to the control housing 20 and extends outwardly and upwardly. As shown in FIGS. 5-7, the back construction 18 is attached to the lower back frame 14 and includes a back support (also referred to as an outer shell) 24 and a cushion assembly 26, including an inner shell 27, attached to the back support 24. The back construction 18 also includes a lumbar assembly 28 which is disposed between the back support 24 and the cushion assembly 26. The cushion assembly 26 is attached to the back support shell with a quick attach hooking top and side connections described further below, and a "ZIP-LOCK" type bottom connection. The back construction 18 also includes an upholstery attachment clip 30 which is wedgingly engaged between the back support 24 and the cushion assembly 26. The upholstery attachment clip 30 makes assembly and disassembly of the back construction easier and less time-consuming.

Figure 9:
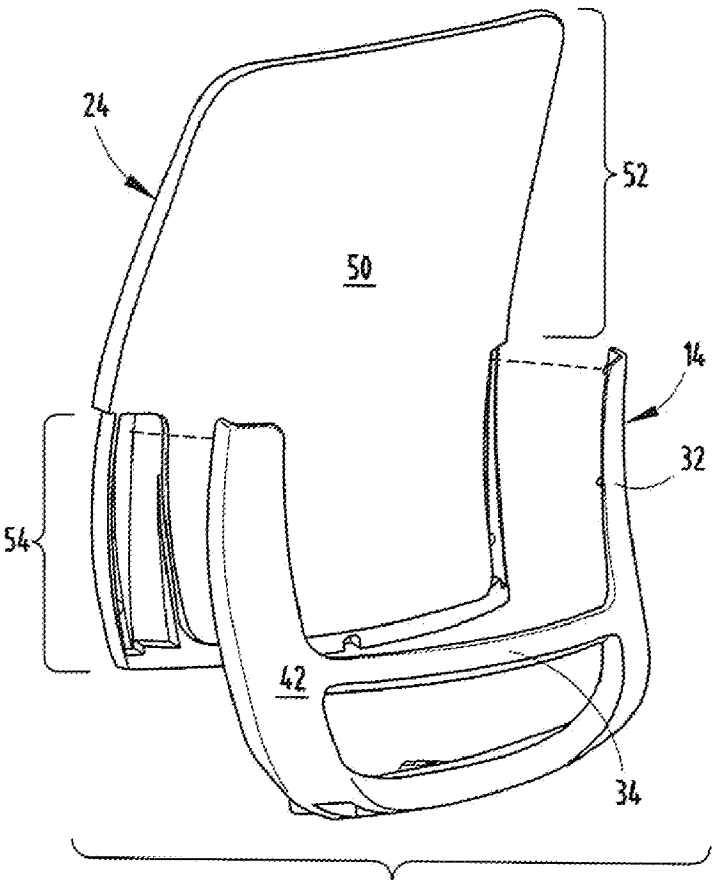
FIGS. 8 and 9 are exploded views of a back support and lower back frame.
Figure 8:
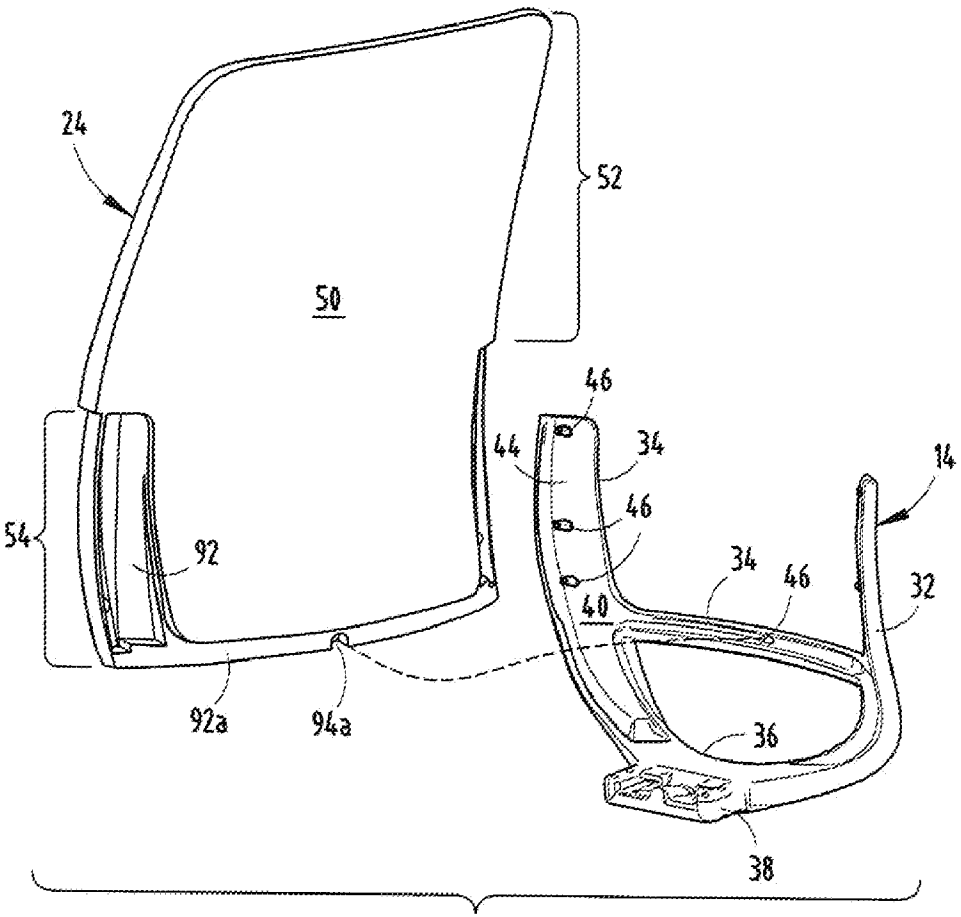

The lower back frame 14 is Y-shaped and includes two uprights 32 and a cross-piece 34, which connects the two uprights 32 (FIGS. 8, 9). The lower ends of the two uprights meet at a vertex 36. A lower back frame structure 38 extends laterally from the vertex 36 and attaches to the control housing 20. The lower back frame 14 includes an inside face 40, which engages the back support 24 and an outside face 42. The inside face 40 of the uprights 32 and the cross-piece 34 attach to the back support 24 and include an overlap flange 44 and apertured bosses 46. The outside face 42 of the cross-piece 34 includes a horizontal recess 47 on the cross-piece's bottom edge.

Figure 10:
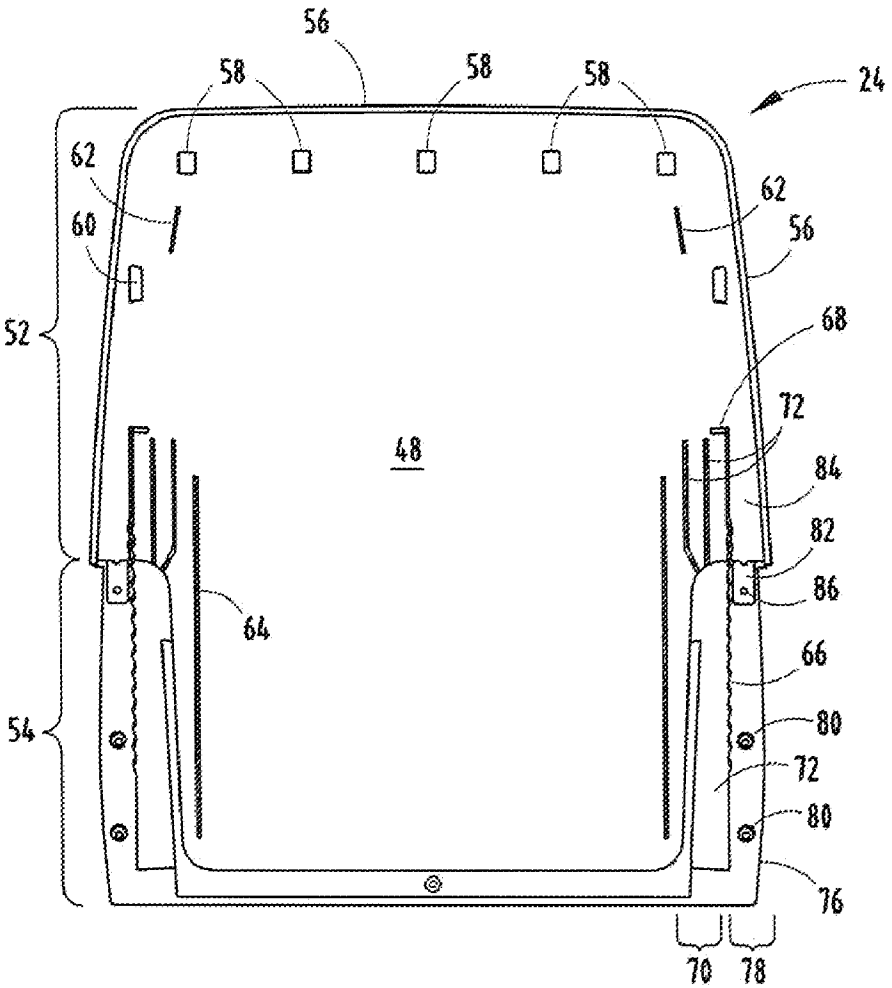
FIG. 10 is a front elevational view of the back support.
Figure 12:
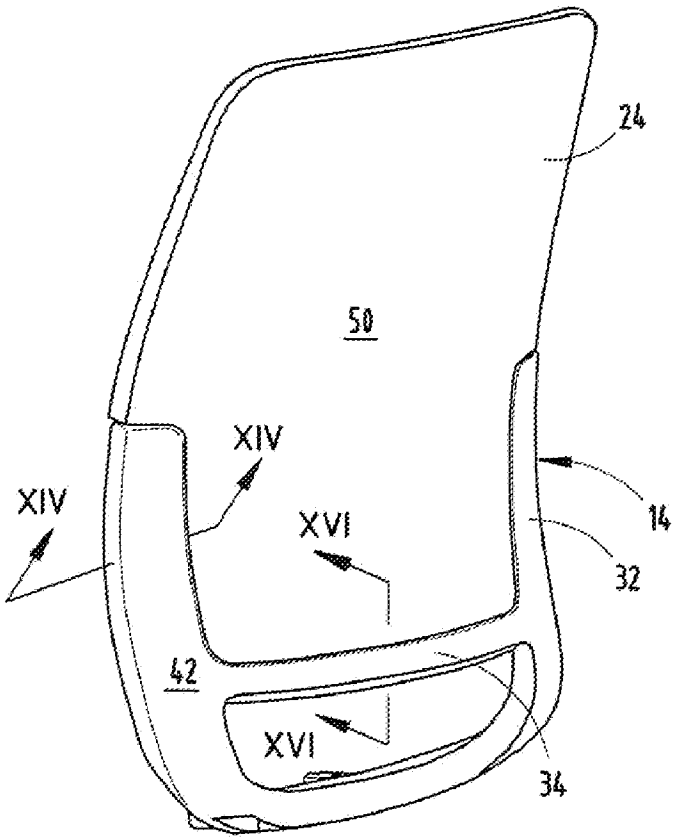
FIG. 12 is a perspective view of the lower back frame and back support of the chair shown in FIG. 4.
Figure 37:
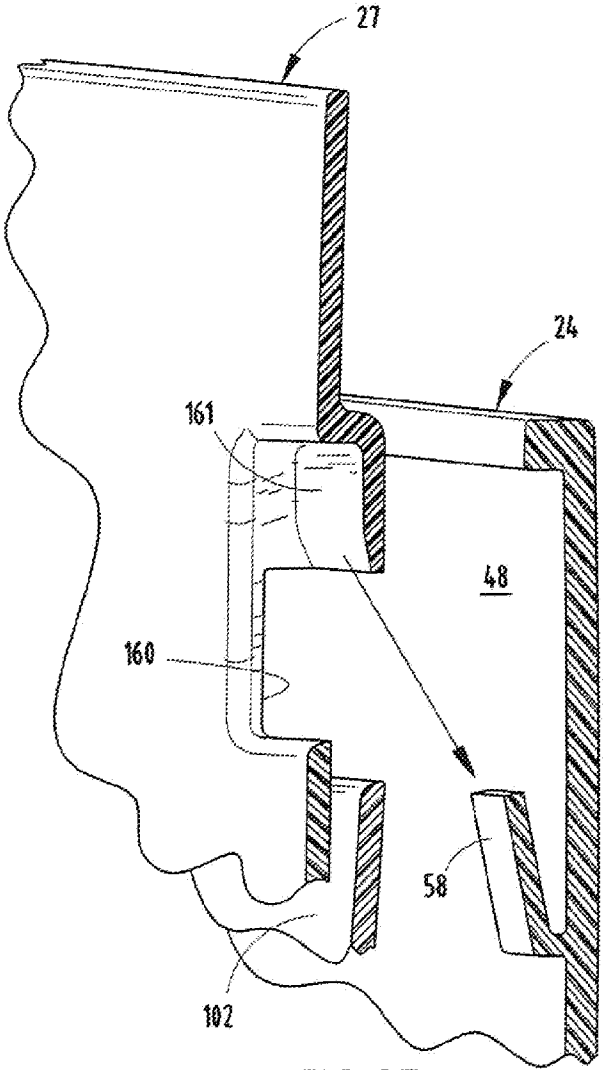
Figure 40:
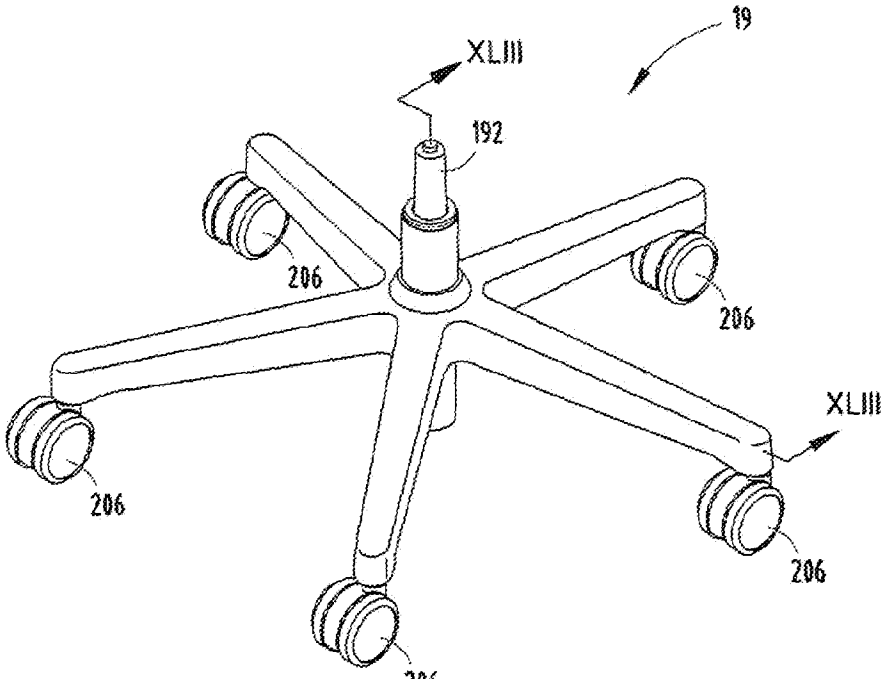
FIG. 40 is a top perspective view of the leg assembly shown in FIG. 39.
Figure 39:
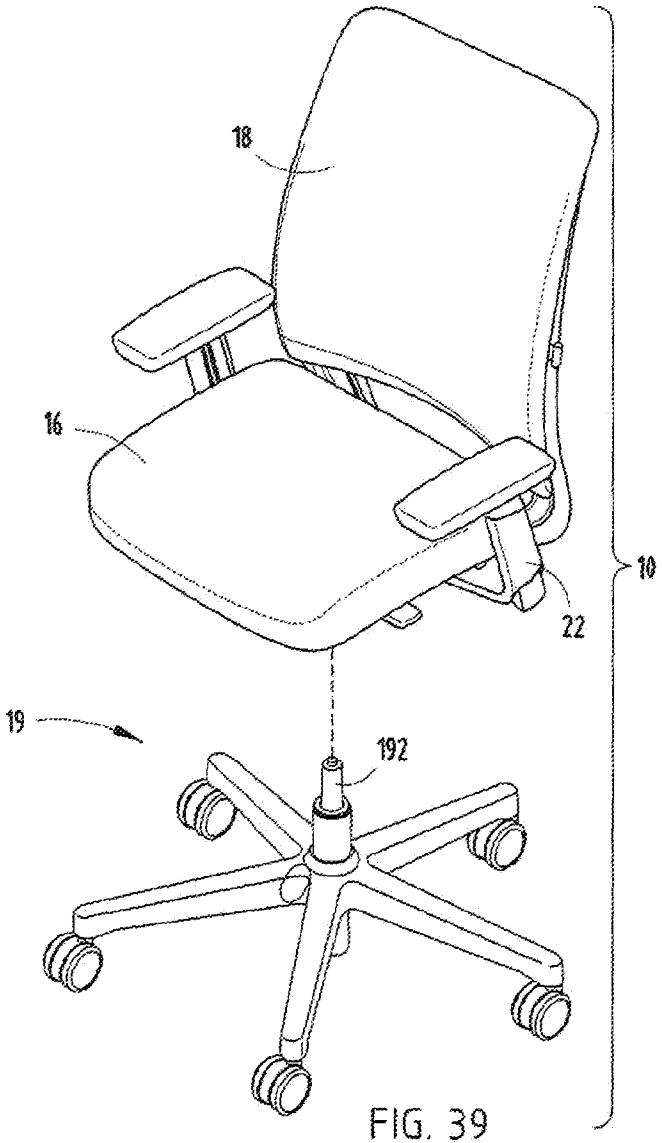
FIG. 39 is an exploded view of the chair including a leg assembly shown in FIG. 1.
Figure 42:
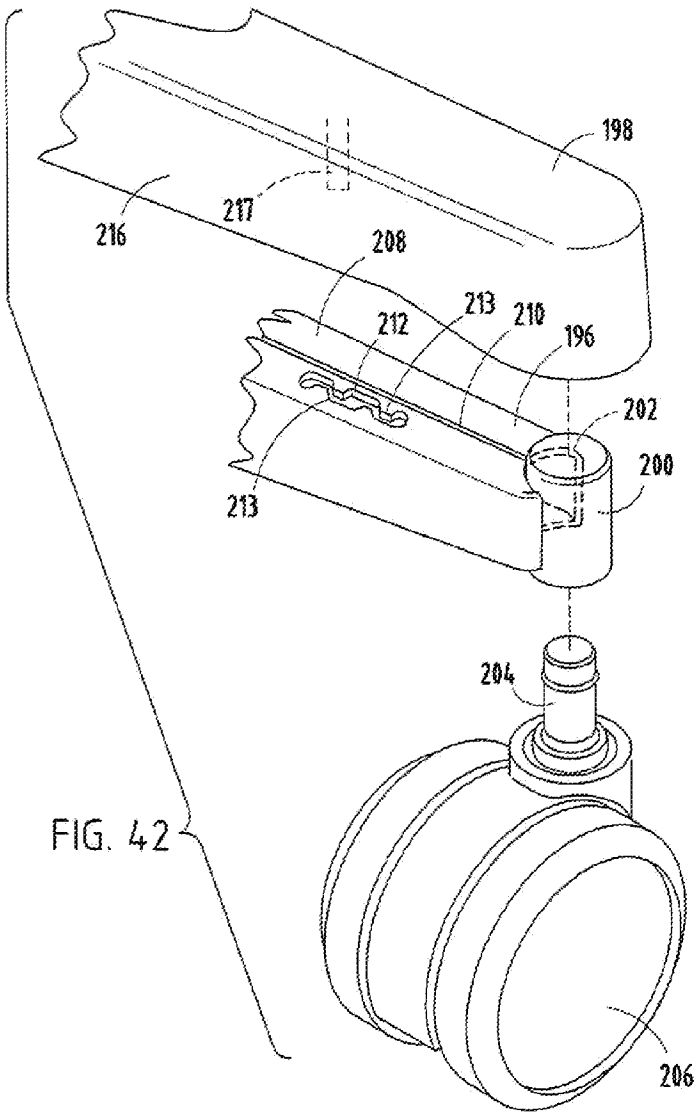
FIG. 42 is an exploded fragmentary view of the leg, leg cover and caster shown in FIG. 41.
Figure 41:
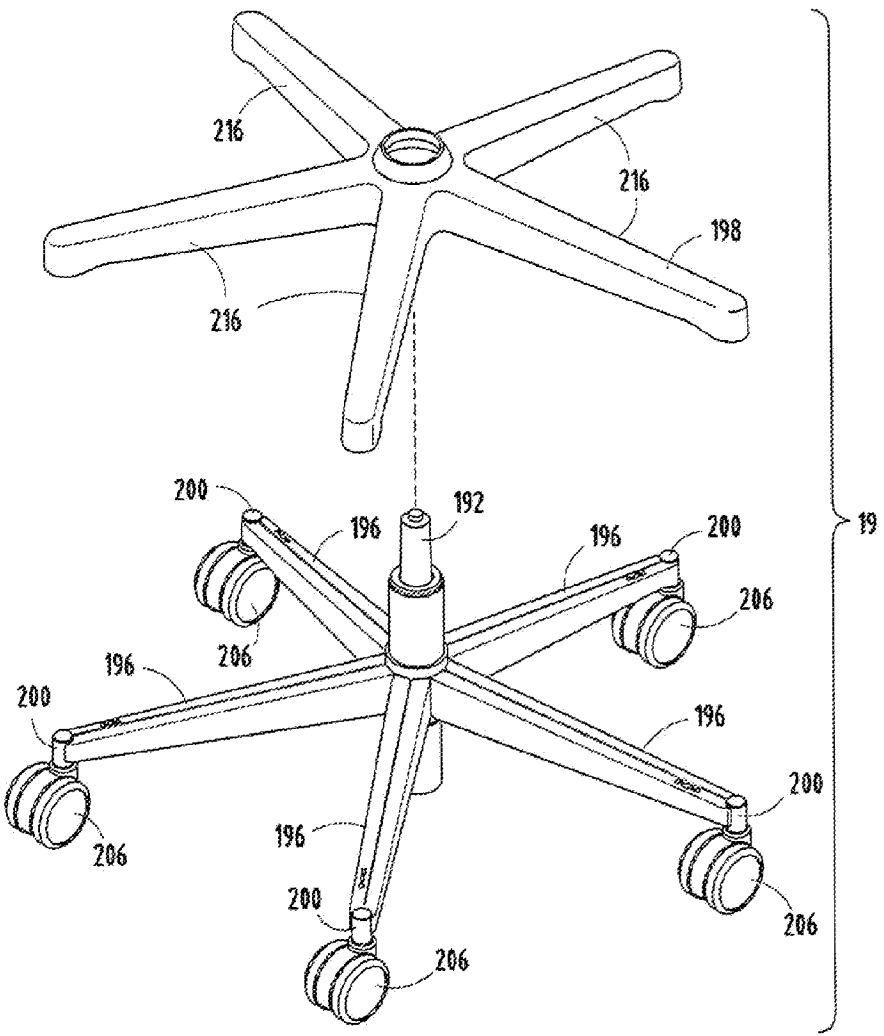
FIG. 41 is an exploded top perspective view of the leg assembly shown in FIG. 40.
Figure 43:
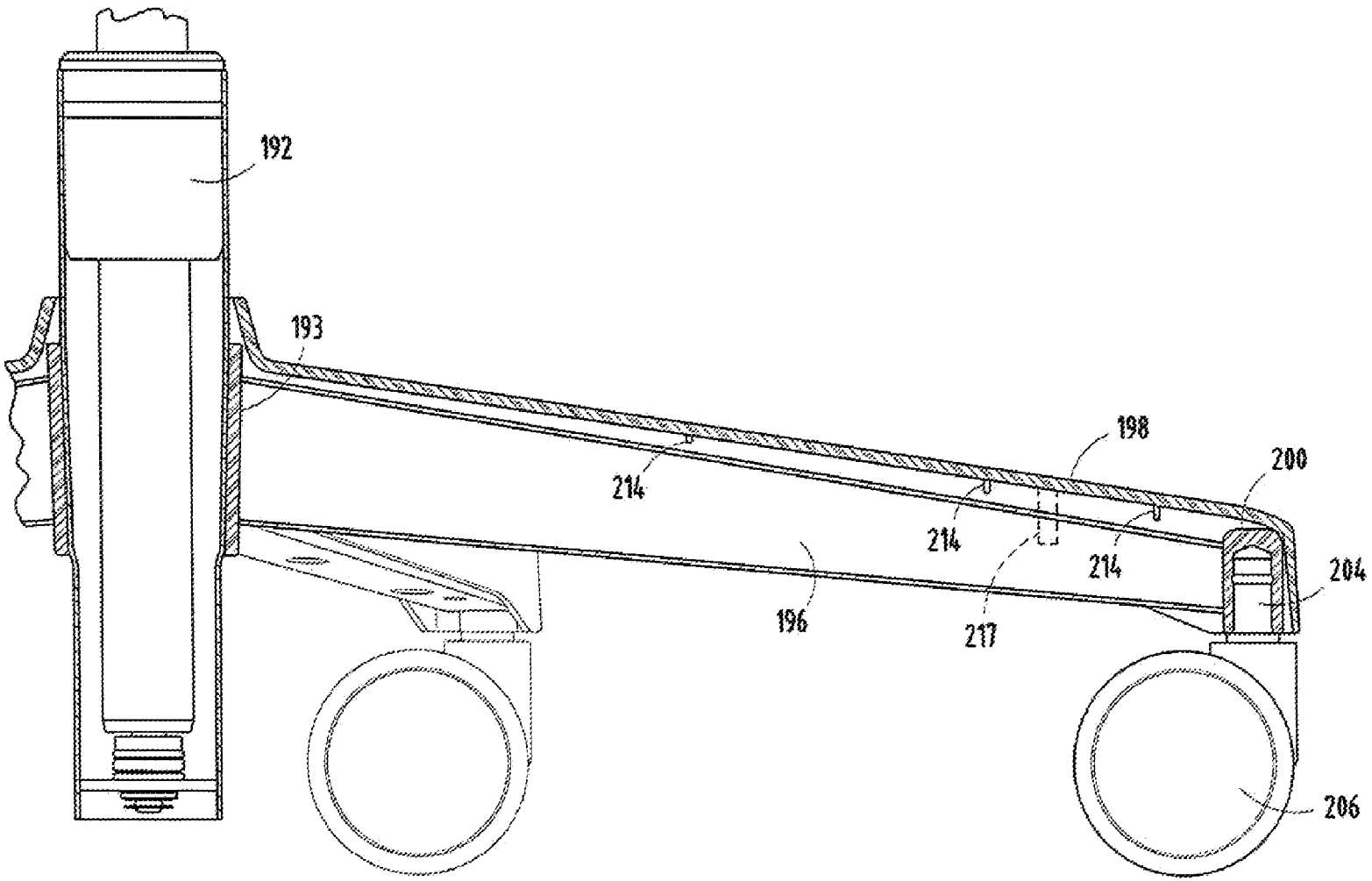
FIG. 43 is a cross-sectional view along the line XLIII-XLIII in FIG. 40.

The back support or outer shell 24 comprises a molded polypropylene material or similar engineering-type structural material, and includes relatively stiff thoracic and pelvic sections. Referring to FIGS. 5 and 8-11, the back support 24 includes an inside face 48 and an outside face 50. The back support 24 also includes an upper (or thoracic) section 52 and a lower (or lumbar/pelvic) region 54. The upper section 52 of the inside face 48 of the back support 24 includes a lip 56 along its top and side edges. A series of hooks 58 are evenly spaced laterally below the top lip 56. The hooks 58 project forwardly and then upwardly. (FIG. 37). Although FIGS. 5 and 10 illustrate one embodiment of the present invention including a series of five hooks laterally spaced below the top edge, it is contemplated that the number of hooks can be more or less than five, preferably three to seven hooks, and more preferably four to six hooks. Also, the shape, length, style, and angle relative to the back support 24 of the hooks 58 may vary depending on the amount of upholstery on the cushion assembly 26 and the shape of the back support 24. In one embodiment, it is contemplated that the center hook would be longer than the remaining hooks. In an alternative embodiment, the center hook is the longest, with the hooks adjacent to the left and right of the center hook being shorter than the center hook, and the remaining hooks being the shortest. In a preferred embodiment, the hooks 58 are all the same length and are angled about 15 to about 20 degrees relative to the back support 24. A hook 60 on the right and left sides of the upper section 52 adjacent to the side lip 56 of the upper section 52 projects upwardly and then inwardly toward the middle of the upper section. In an alternative embodiment, the hooks 60 may project upwardly and outwardly. Adjacent to hooks 60 are ribs 62. The ribs 62 are generally parallel to the side lip 56. When force is applied to the sides of the cushion assembly 26, the ribs prevent the cushion assembly 26 from disengaging from the back support.

Figure 26:
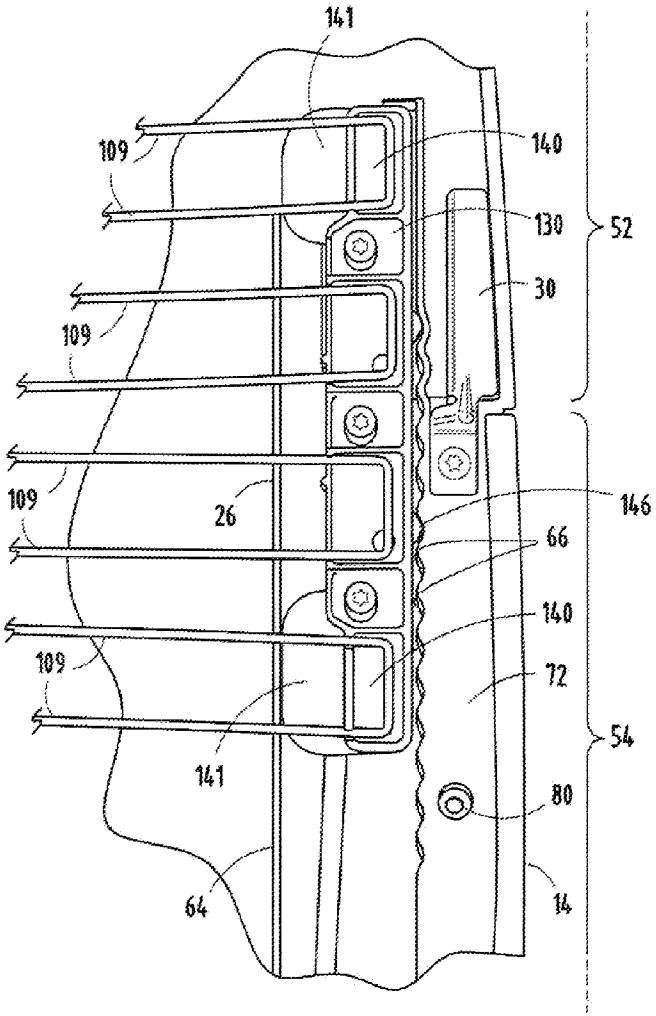
FIG. 26 is an enlarged fragmentary view of the lumbar wire retainer, back support, and clip.
Figure 27:
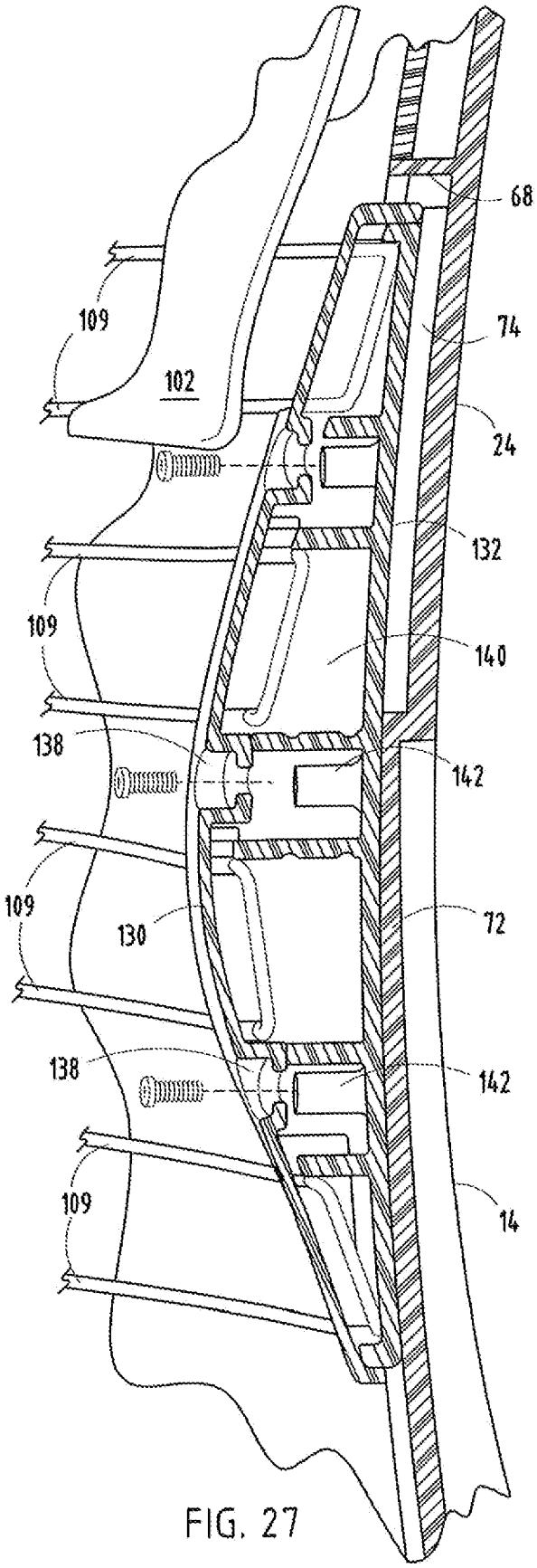
FIG. 27 is a cross-sectional view taken along the line XXVII-XXVII in FIG. 6.

The inside face 48 of the back support 24 also includes a pair of alignment stops 64 and a pair of wave ridges 66. The wave ridges 66 are generally in the shape of a cosine or sine wave and allow for smooth and fluid adjustment of the lumbar assembly 28. The alignment stops 64 and wave ridges 66 are in the lower section 54 of the back support 24 and extend into a lower portion of the upper section 52. The wave ridges 66 terminate at a horizontal stop 68. The area between the alignment stop 64 and the wave ridges 66 defines a first vertical band 70. The first vertical band 70 is in the lower section 54 of the back support 24 and extends into a lower portion of the upper section 52 and includes a ramp 72 and two vertical lips 74. The two vertical lips 74 provide support to the back support 24. The height of the ramp 72 is greatest at the bottom and gradually reduces to the height of the two vertical lips 74 at the top of the first vertical band 70. The area between the wave ridges 66 and the sides 76 of the lower section of the back support define a second vertical band 78. The second vertical band 78 is in the lower section 54 of the back support 24 and extends into a lower portion of the upper section 52. Within the second vertical band 78 are apertures 80, which are used to fasten the back support 24 to the lower back frame 14. Above the apertures 80 are a first recess 82 and a second recess 84. The first recess 82 is in the lower section 54 of the back support 24 and the second recess 84 is in the upper section 52 of the back support 24. The first recess 82 is defined as an indentation within the second vertical band 78. As illustrated in FIG. 10, the first recess 82 is rectangular, however it is contemplated that the first recess can be square or circular in shape. The first recess 82 includes an aperture 86 for attaching the clip 30, discussed further below, to the lower section 54 of the back support 24. Alternatively, the clip 30 may be integral with the back support 24 or may be attached to the inner shell 27, rendering the aperture 86 optional. When attached to the back support, a flange 88 of the clip 30 is disposed within the first recess 82 and the remaining portion of the clip 30 is disposed within the second recess 84. (FIG. 26).

Figure 11:
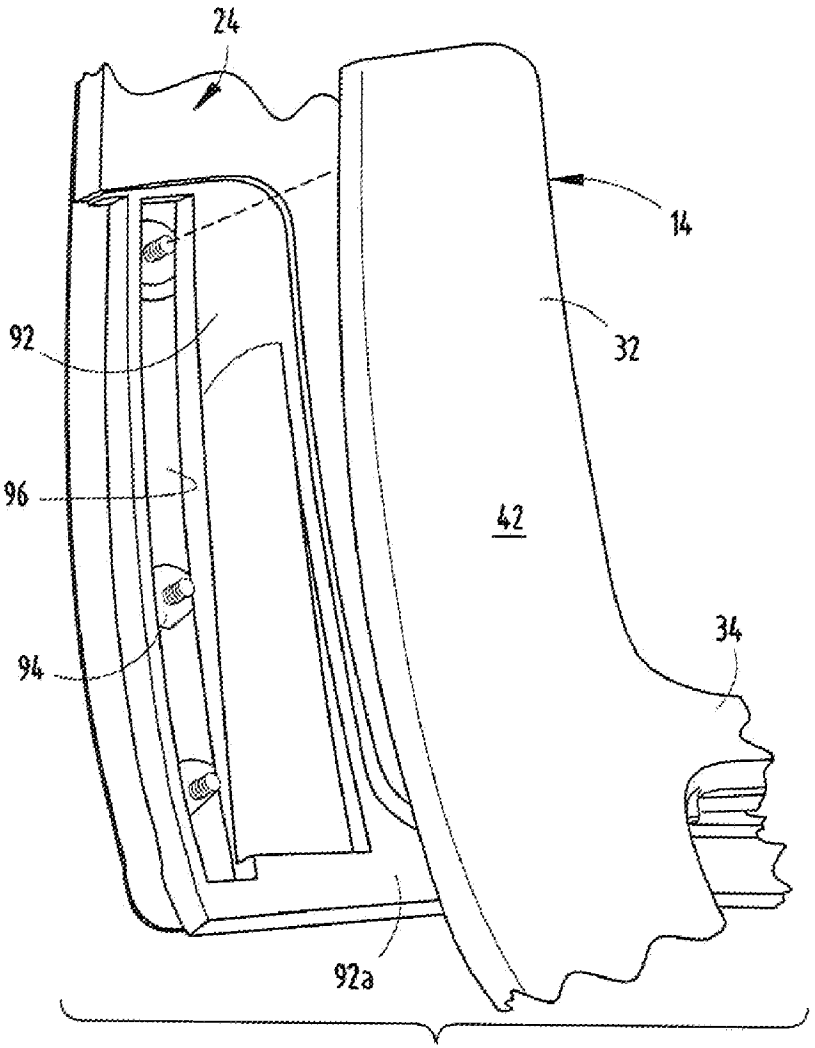
FIG. 11 is an exploded fragmentary view of the outside face of a back support including a channel shaped flange and a lower back frame.
Figure 15:
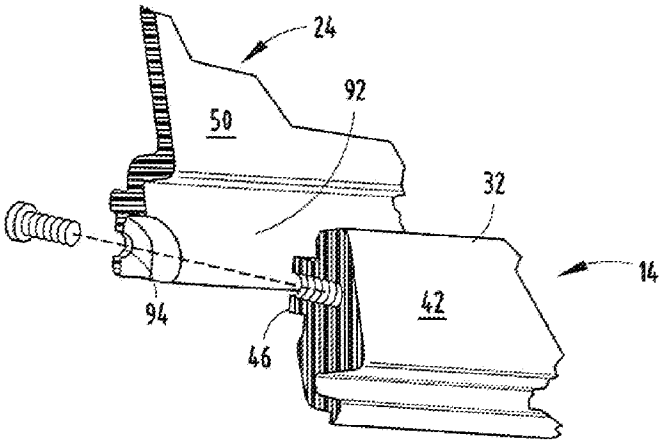
FIG. 15 is an exploded fragmentary view of a bottom edge channel shaped flange and overlap flange spread apart.
Figure 16:
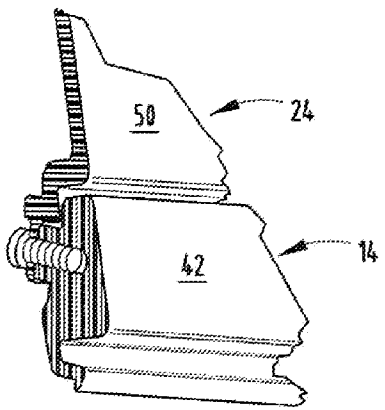
FIG. 16 is a fragmentary view of the overlap joint formed by the bottom edge channel shaped flange and overlap flange shown in FIG. 15 together.
Figure 14:
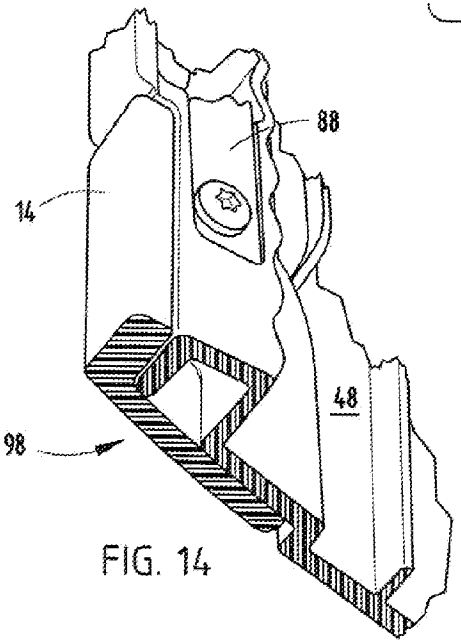
FIG. 14 is a fragmentary view of the overlap joint, including a box beam formed by the side channel shaped flange and overlap flange shown in FIG. 13 together.
Figure 13:
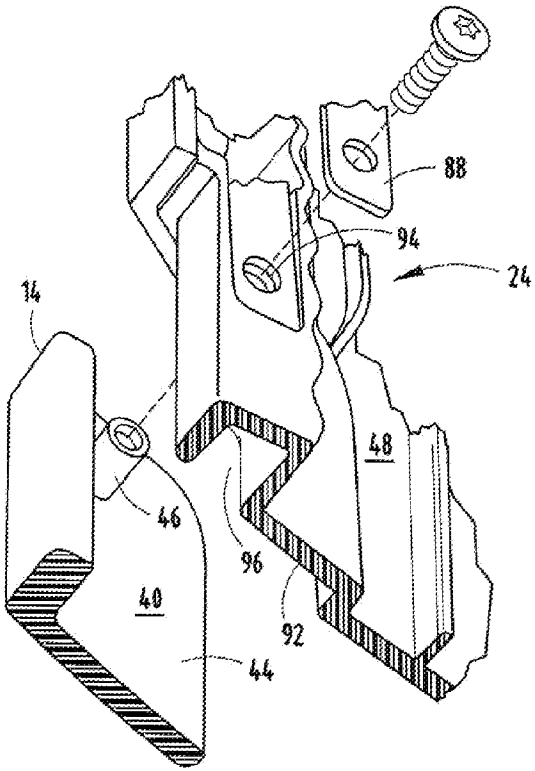
FIG. 13 is an exploded fragmentary view of a side channel shaped flange and overlap flange spread apart.
Figure 18:
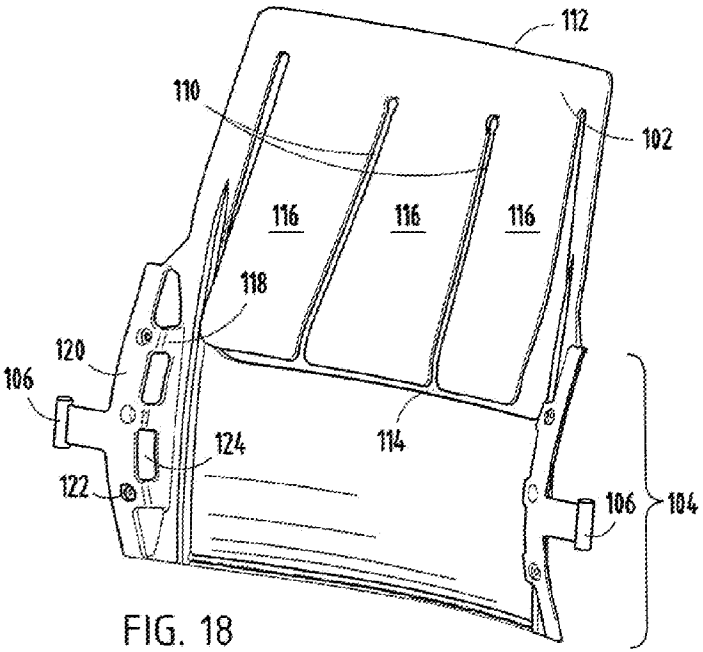
FIG. 18 is a top perspective view of a lumbar frame including a transition shell and a lumbar device support.
Figure 19:
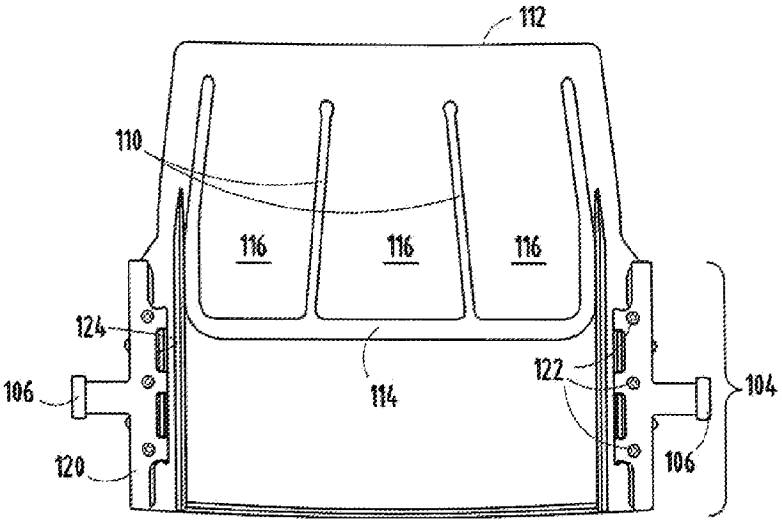
FIG. 19 is a front elevational view of the lumbar frame in FIG. 18.
Figure 20:
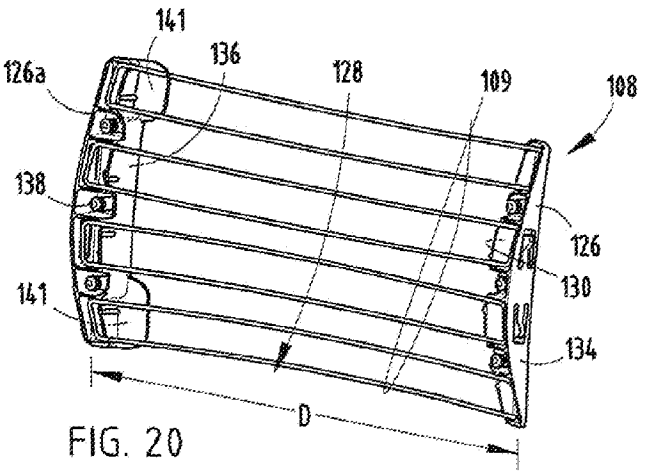
FIG. 20 is a top perspective view of a lumbar device.
Figure 21:
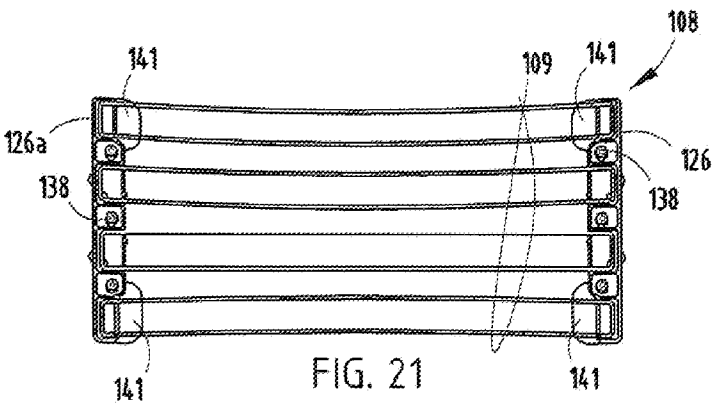
FIG. 21 is a front elevational view of the lumbar device in FIG. 20.
Figure 23:
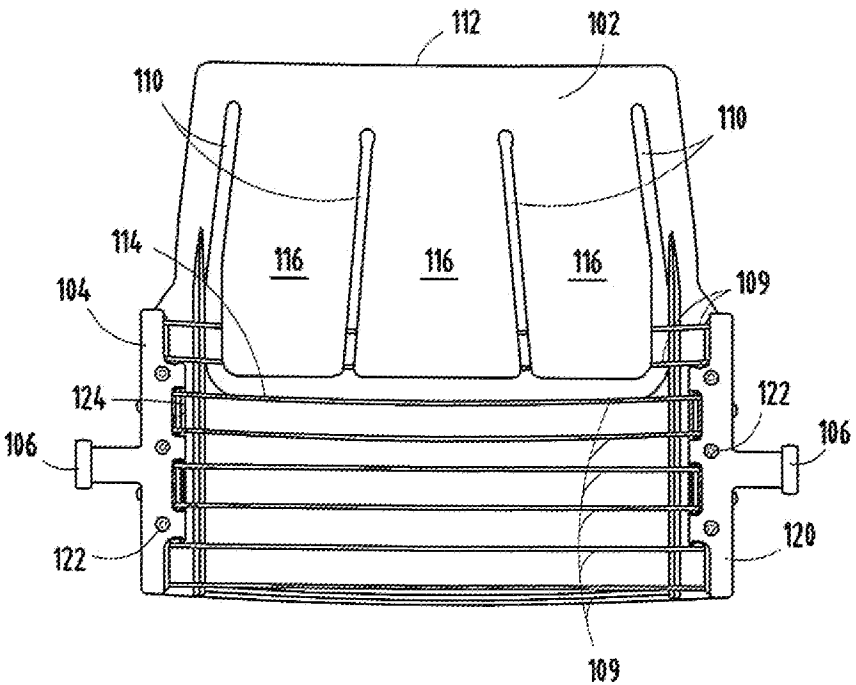
FIG. 23 is a front elevational view of the lumbar assembly of FIG. 22.
Figure 22:
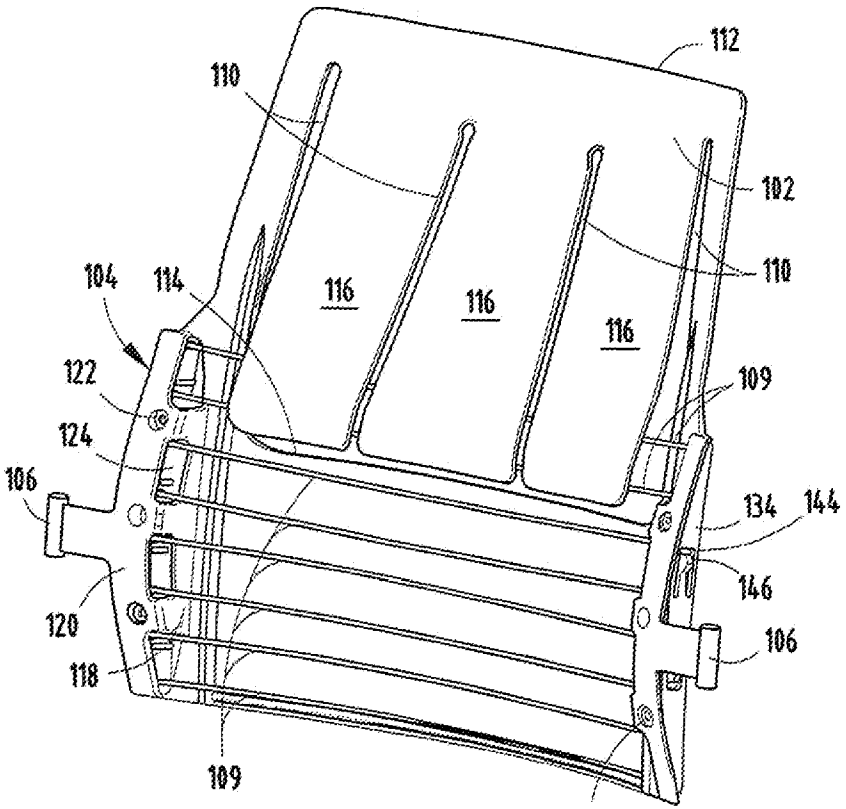
FIG. 22 is a top perspective view of a lumbar assembly.
Figure 24:
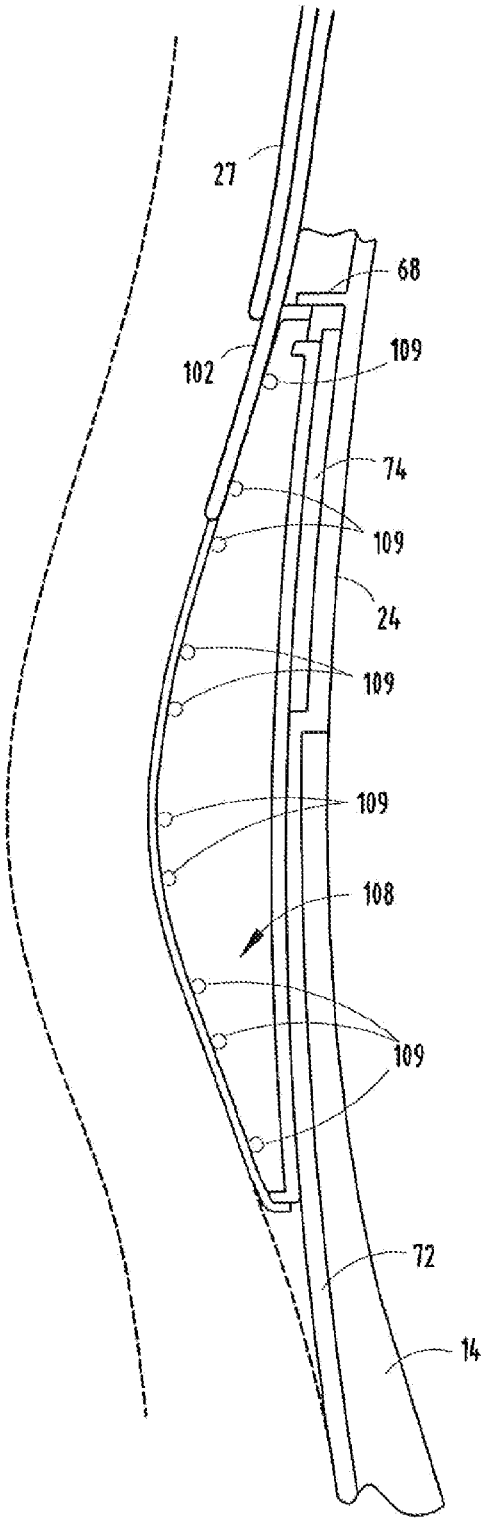
FIGS. 24 and 25 are cross-sectional views of the back construction showing the movement of the lumbar assembly.
Figure 25:
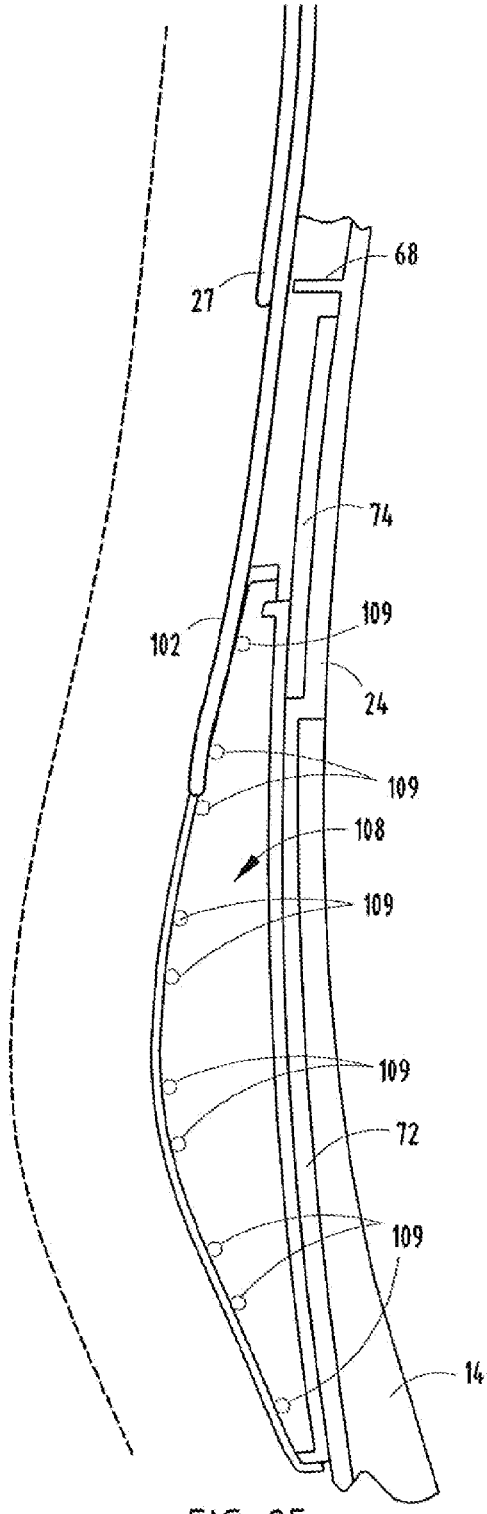
Figure 28:
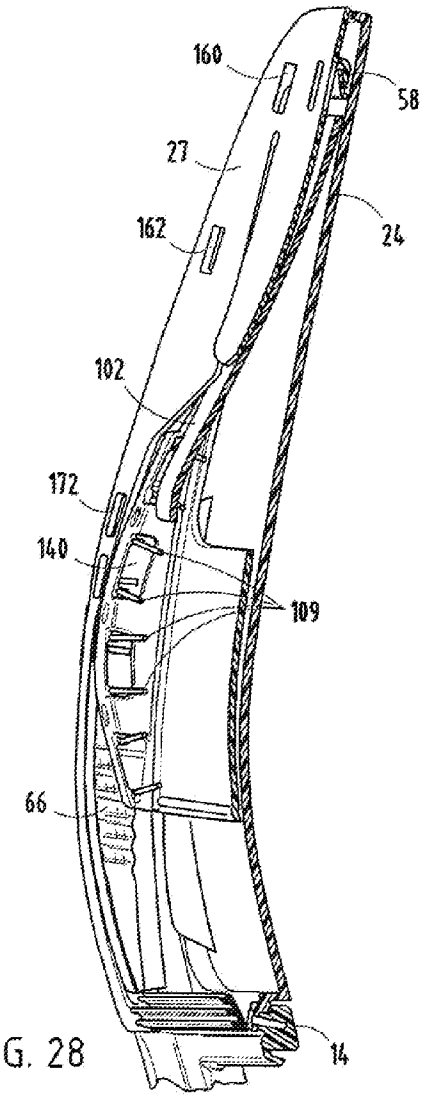
FIG. 28 is a cross-sectional view taken along the line XXVIII-XXVIII in FIG. 6.

On the outside face 50 of the back support 24, the side and bottom edges of the lower section 54 include a channel-shaped flange 92 and 92*a* and apertures 94 and 94*a*, (FIGS. 8 and 11). As shown in FIG. 11, on the side edges of the lower section 54, apertures 94 are located within a recess 96. To attach the lower frame 14 to the back support 24, the inside face 40 of the lower back frame 14 is placed in contact with the lower section 54 of the outside face 50 of the hack support 24, such that the overlap flange 44 on the lower frame 14 and channel-shaped flange 92 and 92*a* on the back support 24 mate to form an overlap joint. (See FIGS. 11-16). The overlap flanges of the uprights and the cross-piece and the channel-shaped flanges of the back support mate to form a U-shaped overlap joint. Fastening means, such as screws, are inserted through apertures 94 and 94*a* and anchored in the apertured bosses 46. The resulting overlap joint formed on the bottom edge of the back support is illustrated in FIG. 16. On the side edges of the outside face 50 of the back support 24, the overlap flange 44 of the lower back frame 14 mates with the channel-shaped flange 92 of the back support 24 to form an overlap joint including a box beam 98 (FIGS. 13, 14). The box beam 98 provides additional structural support to the lower section of the back support. Notably, this overlap joint configuration allows for variations in manufacturing tolerances of the lower back frame and back support, thereby facilitating assembly of the back construction 18.

As illustrated in FIG. 5, in one embodiment of the present invention, a vertically adjustable lumbar assembly 28 is positioned between the cushion assembly 26 and the back support 24. Referring to FIGS. 18-23, the lumbar assembly 28 is vertically adjustable to provide optimal comfort to a seated user and includes a lumbar frame including a transition shell 102, a lumbar device support 104 including side handles 106, and a lumbar device 108 including lumbar-energy wires 109. The transition shell 102 includes slits 110, which extend from near a transition shell upper edge 112 to a transition shell lower edge 114 to form vertical strips 116. In another embodiment, the transition shell is not a part of the lumbar frame, but rather is separate and attached to the wires 109 of the lumber device 108. The lumbar device support 104 includes a first vertical flange 118 which projects outwardly from the lower portion of the lumbar frame 28 and a second vertical flange 120 which is oriented approximately perpendicular to the first vertical flange 118. Projecting outwardly from the second vertical flange 120 are handles 106. The second vertical flange 120 also includes fastening apertures 122 for attaching the lumbar device 108 to the lumbar device support 104. The lumbar device support 104 also includes openings 124 located where the first and second vertical flanges 118 and 120 intersect to form a corner.

The lumbar device 108 includes a pair of lumbar-energy wire retainers 126 and 126*a* in which a plurality of flexible lumbar-energy wires 109 are held in a horizontal position. In a preferred embodiment, the length of the lumbar-energy wires 109 are longer than a distance, D, between the wire retainers 126 and 126*a*, such that the wires slightly bend when placed in the wire retainers. (See FIG. 20). The slightly bent, wires form a curved surface 128, which when the lumbar device is attached to the lumbar frame, pushes in the direction of the back support 24 of the back construction 18 to provide active lumbar support. Also, in this embodiment, the wires exert an outward force on the wire retainers 126 and 126*a* which facilitates contact between tabs 146 and the wave ridges 66. In alternative embodiments, the curved surface can be formed using a center vertical strap spanning the front of the wires, a central vertical strap wrapped around the lumbar assembly, or a tensioning element placed in front or back of the lumbar assembly which includes a plurality of loops wrapped around the wires 109. As the strap or tensioning element is tightened the wires 109 will push in toward the back support.

Referring to FIGS. 20, 21, 26 and 27, the lumbar-energy wire retainers 126 and 126*a* include a convex front surface 130, a rear surface 132, an outside side surface 134, and an inside side surface 136. The convex front surface 130 includes apertures 138 used in attaching the lumbar device 108 to the lumbar device support 104, and wells 140 for holding the lumbar-energy wires 109 in the lumbar retainers 126 and 126*a*. Preferably, the front surface 130 includes four wells 140, however if is contemplated that the front surface could include three or more wells. As presently configured, each well 140 includes a pair of lumbar-energy wires 109. The pair of horizontal wires 109 are formed using a single wire, bent into the shape of a rectangle with one end of the rectangle including the two ends of the wire. To facilitate assembly of the lumbar device, the two ends of the wire may be connected by means such as resistance welding. However, alternatively, the ends may be left separated. One end of the rectangle is positioned in a well 140 of wire retainer 126 with the opposite end of the rectangle positioned in an opposite well of wire retainer 126*a*. In another embodiment of the present invention, one or more single wires may be positioned in a given well, however this is not preferred. When using individual wires, the ends of the wires are attached to the wire retainers by means of a hook, which increases the depth of the wire retainers.

The rear surface 132 of wire retainers 126 and 126*a* is slidably engaged to the ramp 72 of the back support 24 (FIGS. 24-27). Notably, the rear surface 132 and the ramp 72 are concentric, which allows the lumbar device 108 to remain engaged with the ramp when the device is vertically adjusted. This concentric configuration prevents the formation of gaps between the lumbar assembly 28 and back: support 24, thereby providing smooth adjustment of lumbar support. The rear surface 132 also includes tabular flanges 141. The tabular flanges 141 are on both ends of the rear surface 132 and extend inward. The tabular flanges 141 provide structural stability to the wire retainers 126 and 126*a*. When the lumbar assembly 28 is in contact, with the back support, the tabular flanges 141 abut the alignment stops 64 of the back support 24. The rear surface 132 also includes apertured bosses 142 used in attaching the lumbar device 108 to the lumbar device support 104. The outside surface 134 of the pair of wire retainers includes oppositional detents 144. The detents 144 include tabs 146 which slidably engage the wave ridges 66 to hold the lumbar assembly 28 in a selected position.

As assembled, the wire retainers 126 and 126*a* are positioned under the lumbar device, support 104. A fastening means is inserted through apertures 122 and apertures 138 and into apertured bosses 142. One end of a rectangle providing a pair of lumbar-energy wires 109 are positioned in a well 140 of the lumbar-wire retainer 126. The pair of horizontal lumbar energy wires 109 pass through an opening 124 in the lumbar device support 104, extend across the lumbar device support, pass through an opening 124 on the opposite side of the lumbar device support, allowing the second end of the rectangle providing the pair of lumbar-energy wires 109 to be positioned in a well 140 of the lumbar wire retainer 126*a* positioned under the opposite side of the lumbar device support. The lower edge of the vertical strips 116 of the transition shell 102 is positioned on top of the uppermost lumbar-energy wires 109. To vertically adjust the lumbar assembly 28, a user engages at least one handle 106, preferably two handles 106, and moves the handle in either an upward or downward direction. As noted above, the wire retainers are slidably engaged to ramp 72 of the back support 24. As the lumbar assembly is adjusted upward, the wire retainers also slidably engage vertical lips 74. The tabs 146 on wire retainers 126 and 126*a* slidably engage the wave ridges 66 on the back support to hold the lumbar assembly 28 in a select position. Vertical adjustment of the lumbar assembly is limited in an upward direction by the horizontal stop 68 on the back support and in a downward direction by the lower end of the ramp 72. The transition shell upper edge 112 slides between the back support 24 and the cushion assembly 26 when the lumbar assembly is adjusted vertically. Notably, the transition shell 102 allows the horizontal wires 109 of the lumbar device 108 to slide vertically between the cushion assembly 26 and the back support 24 without objectionable friction. The transition shell 102 also distributes stress across the horizontal wires 109.

Figure 17:
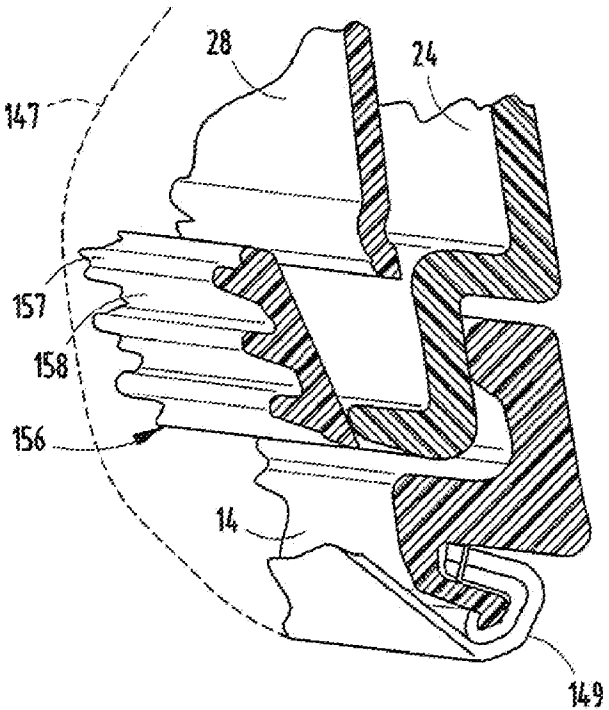
FIG. 17 is a cross-sectional view taken along the line XVII-XVII shown in FIG. 6.

The cushion assembly 26 includes a cover assembly 147 similar to the cover assembly disclosed in U.S. Pat. No. 6,220,661, issued Apr. 24, 2001, entitled "CHAIR BACK AND METHOD OF ASSEMBLY," the entire contents of which are incorporated herein in its entirety by reference for its teachings, a cushion 148 and an inner shell 27, (FIG. 5). The cover assembly 147 includes an upholstery front panel and a rear panel forming a sock that can be inverted and pulled upwardly onto the cushion 148 and inner shell 27 as the cover assembly is inverted. The rear panel includes a fabric section which hangs downwardly from the front panel and has a strip of stiff material 149 sewn along its lower edge to form a stiffened edge flange. The strip of stiff material 149, such as polyethylene, and is generally in the shape of an inverted "J". (See FIG. 17). The stiffened edge flange can be pressed or "zipped" into, and frictionally retained in, a horizontal recess 47 of the lower back frame 14.

The cushion 148 comprises a polyethylene terephthalate (PETE) matting, preferably including recycled content, or alternatively, polyurethane foam and includes a rear surface shaped to mateably receive the inner shell 27.

Figure 29:
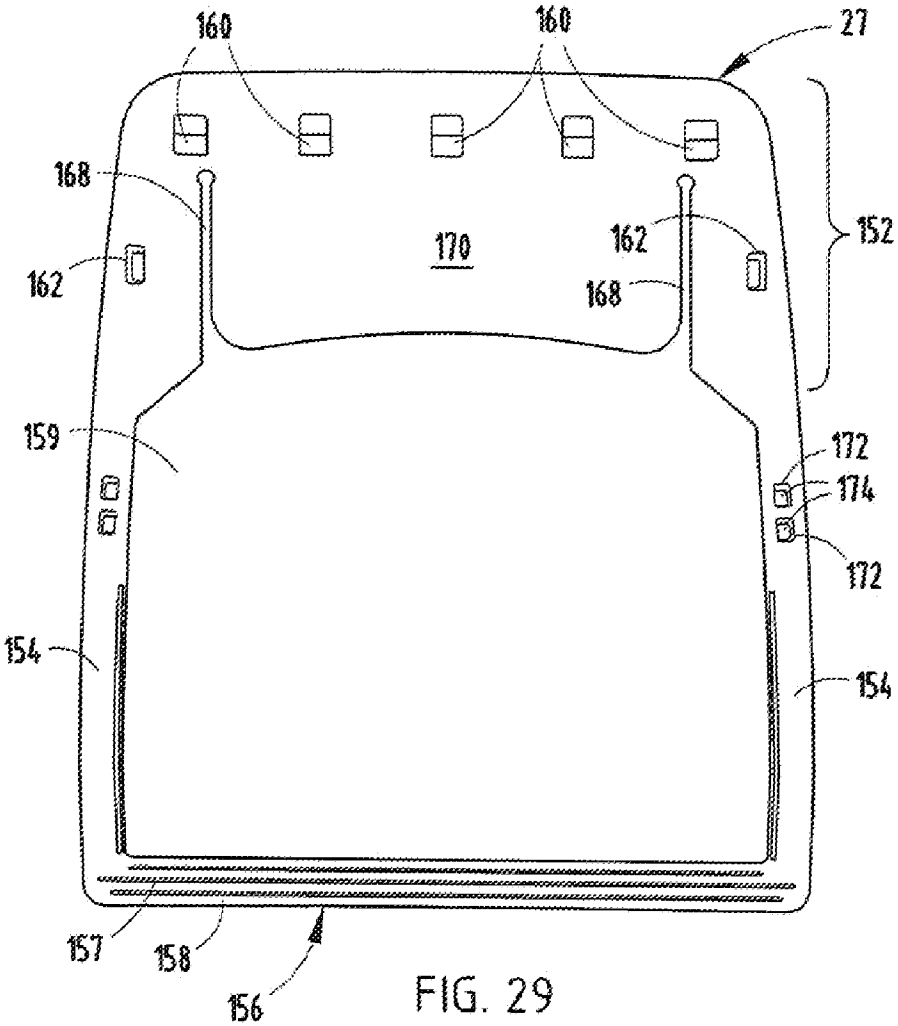
FIG. 29 is a front elevational view of the inner shell.
Figures 30, 30A:
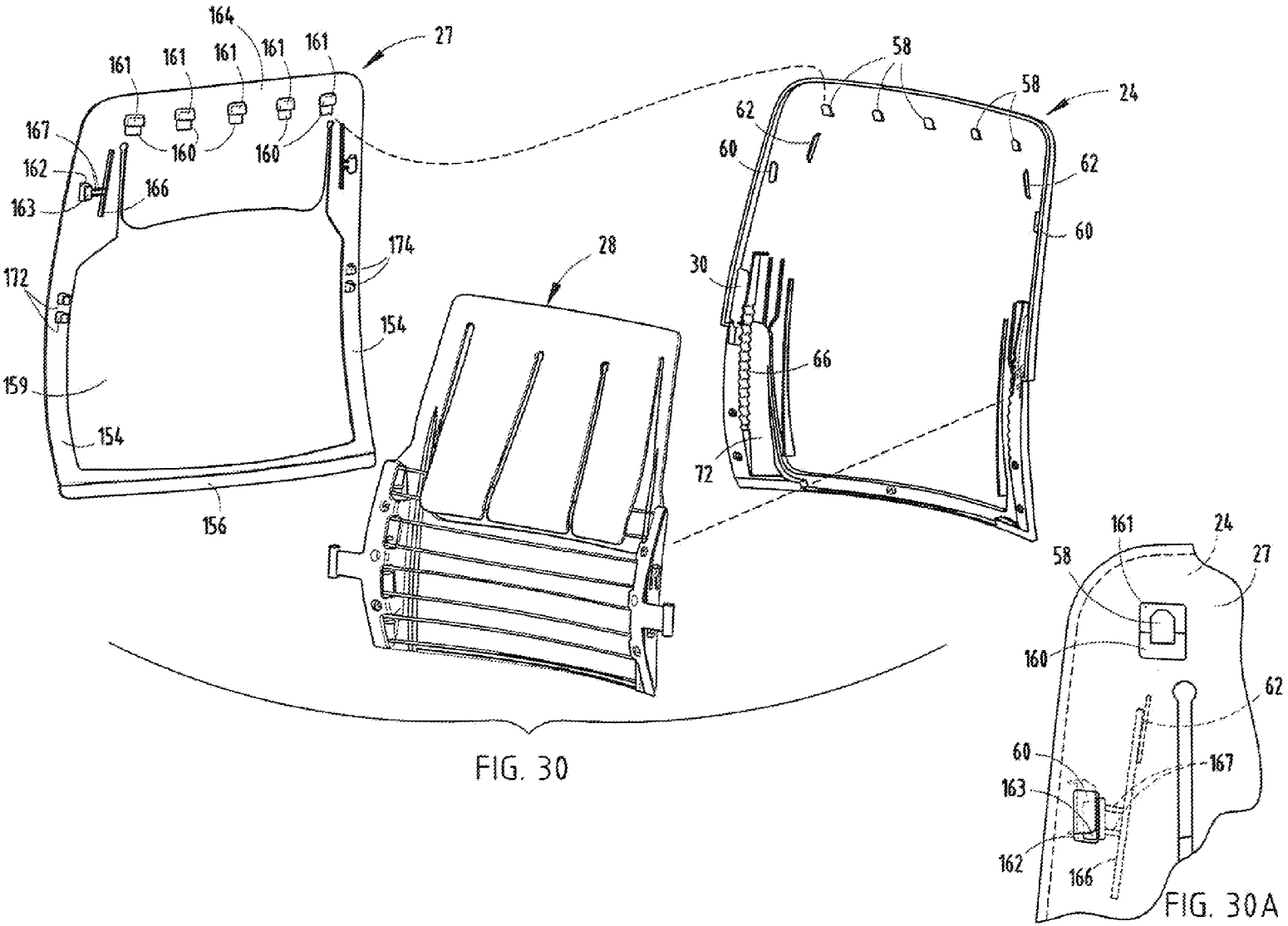
FIG. 30 is an exploded view of the back construction, including a back support, lumbar assembly, and inner shell.
FIG. 30A is an enlarged fragmentary view of the upper right section of the inner shell and back support showing the configuration of the vertical ribs when the inner shell and back support are connected.

The inner shell 27 comprises a polypropylene panel and is adhered to the cushion 148 as needed to maintain the stability of the cushion assembly 26. As illustrated in FIG. 29, the inner shell 27 includes a top section 152, and side perimeter bands 154 and a bottom perimeter band 156 that extend down the side edges and along the bottom of the inner shell 27, which define an opening 159. The inner shell 27 also includes evenly spaced apertures 160, including an overhang 161, across the top that correspond to hooks 58 and an aperture 162, including an overhang 163, located on the upper left and upper right portions of the inner shell which correspond to hooks 60. (FIG. 30). The front side of the bottom perimeter band 156 includes ridges 157 and valleys 158. (FIG. 29). The ridges 157 and valleys 158 provide structural support to the inner shell 27. On the rear side 164 of the inner shell 27, illustrated in FIG. 30, adjacent to apertures 162 are ribs 166. The ribs 166 are parallel to the side edges of the inner shell 27. A pair of horizontal ribs 167 connect the overhang 163 and the rib 166. The horizontal ribs 167 provide structural support to the overhang 163 and ribs 166. As illustrated in FIG. 30A, when the back construction 18 is assembled, ribs 62 on the inside face 48 of the back support 24 and ribs 166 on the rear side 164 of the inner shell 27 are parallel and abut longitudinally. This configuration prevents the sides of the cushion assembly from excessively pulling in towards the center of the back construction and causing gaps between the cushion assembly and back support.

Figure 31:
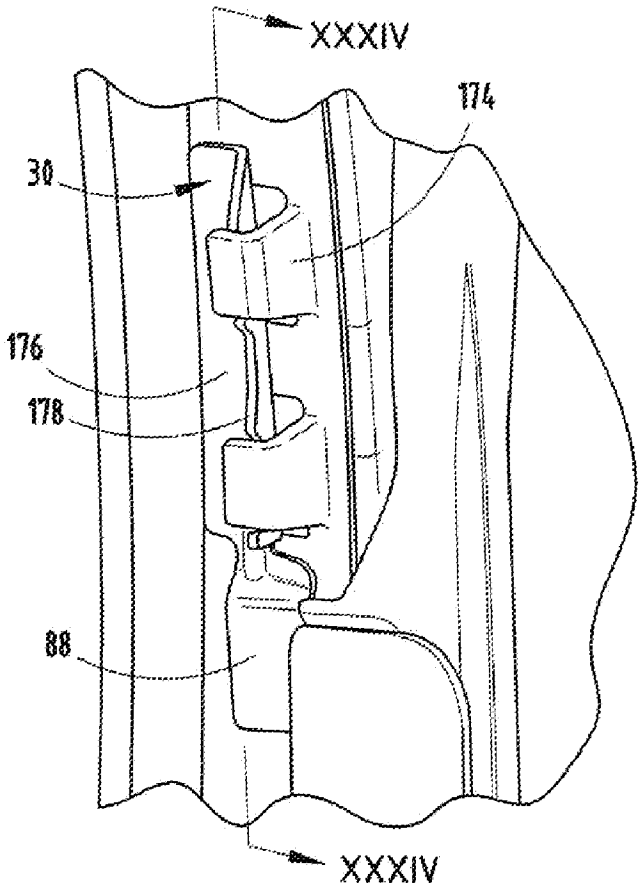
FIG. 31 is an enlarged fragmentary view showing a clip wedgedly engaged in hooks extending downwardly and outwardly from apertures in the inner shell.

The top section 152 of the inner shell 27 may also include, slits 168 which extend upwardly from the opening 159 and terminate below apertures 160. The area between the slits 168 defines a flap 170. The slits 168 and flap 170 enhance the flexibility of the inner shell. The inner shell 27 also includes two or more apertures 172 on the side perimeter bands 158 and an associated hook 174 adjacent an aperture 172, extending downwardly and outwardly from each aperture 172 (FIGS. 30, 31). Preferably, the inner shell 27 includes two apertures 172 and hooks 174, however, it is contemplated that the inner shell may include more than two apertures 172 and hooks 174. Notably, the hooks 174 extending from each aperture 172 are oriented perpendicular to the hooks 58 located across the top of the back support 24. The hooks can be oriented in an outboard or inboard direction, preferably an outboard direction. This configuration prevents the hooks in the back construction from disconnection caused by the application of forces on the chair during use. In an alternative embodiment, the more than two apertures 172 and hooks 174 may be on the back support 24.

Figure 34:
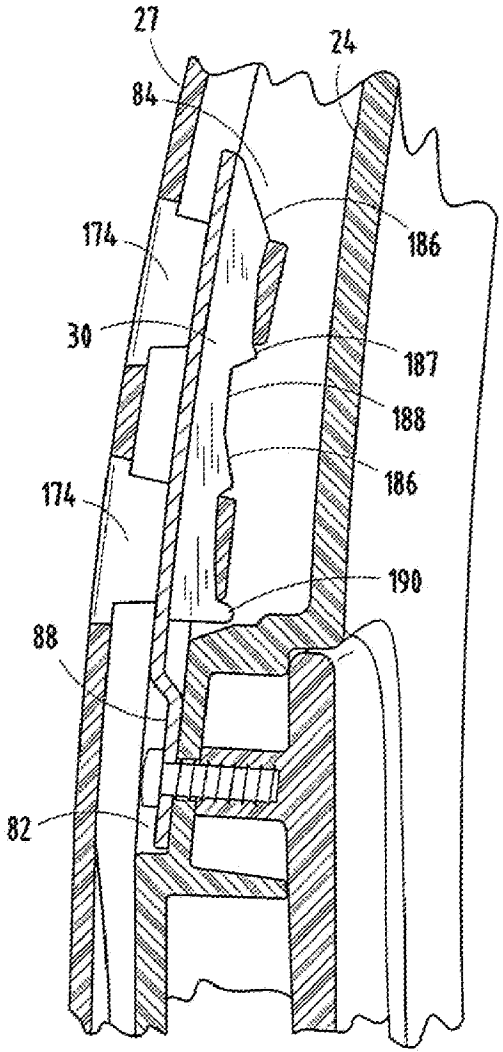
FIG. 34 is a cross-sectional view taken across XXXIV-XXXIV in FIG. 31.
Figure 33:
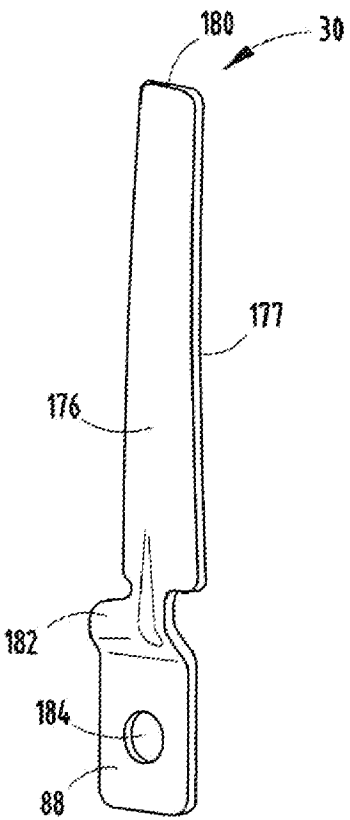
FIGS. 32 and 33 are front and rear elevational views of the clip.
Figure 32:
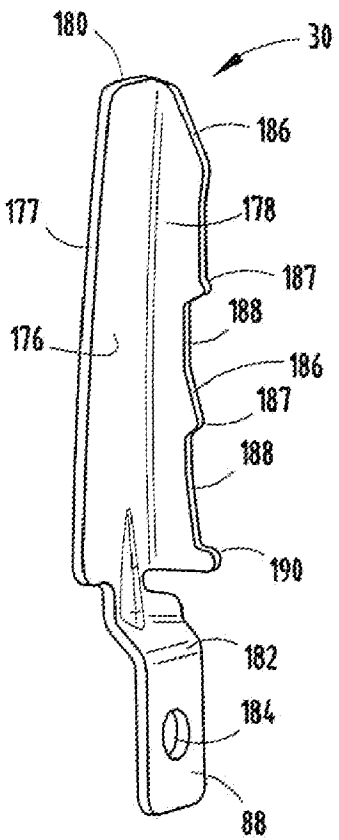

A clip 30 (FIGS. 32 and 33) is attached to the back support 24 as illustrated in FIG. 26. In another embodiment, it is contemplated that the clip 30 is not connected to the back support 24 by means of fasteners, but rather the clip is a part of, and integral with, the back support. In yet another embodiment, the clip 30 may be either attached 20 or integral with the inner shell 27. The clip 30 is preferably made of steel, but may also be composed of any stiff metal or plastic material. The clip 30 includes a main body portion 176, and a side flange 178. When the clip 30 is attached to the back support 24 or inner shell 27, the clip also includes a fastening flange 88. As illustrated, the main body portion 176 includes a side edge 177 and an angled edge 180 and is in approximately the same plane as the fastening flange 88. The main body portion 176 and fastening flange 88 are connected by a bent portion 182. The geometry of the bent portion 182 may vary depending on the construction of the back support 24 or inner shell 27. The fastening flange 88 includes an aperture 184 through which a fastening means attaches the clip 30 to the back support 24. Where the clip 30 is integral with the back support 24 or inner shell 27, the bent portion 182 and the fastening flange 88 are optional. An edge of the main body portion 176 abuts an edge of the side flange. The side flange 178 is approximately perpendicular to the main body portion 176, and includes at least one angled ramp 186. In a preferred embodiment, the clip 30 includes two or more angled ramps 186. The side flange 176 also includes at least one stop 187 where the width of the side flange 88 is greatest, and at least one indentation 188 located between a stop and a subsequent angled ramp, where the width of the side flange 178 narrows, and an end portion 190. Preferably, the side flange 176 includes two or more stops 187 and indentations 188. As noted above, the clip 30 may be attached to or integral with either the back support 24 or inner shell 27. When the clip 30 attaches to the back support 24, the fastening flange 88 of the clip 30 is placed into the first recess 82, allowing the remainder of the clip, namely the main body portion 176 and side flange 178, to be disposed within the second recess 84, and then a fastening means is inserted through the aperture 184 of the fastening flange 88 and into the fastening aperture 86 of the back support 24. (FIG. 34). When disposed within the second recess 84, the main body side edge 177 abuts the back support lip 56.

Figure 35:
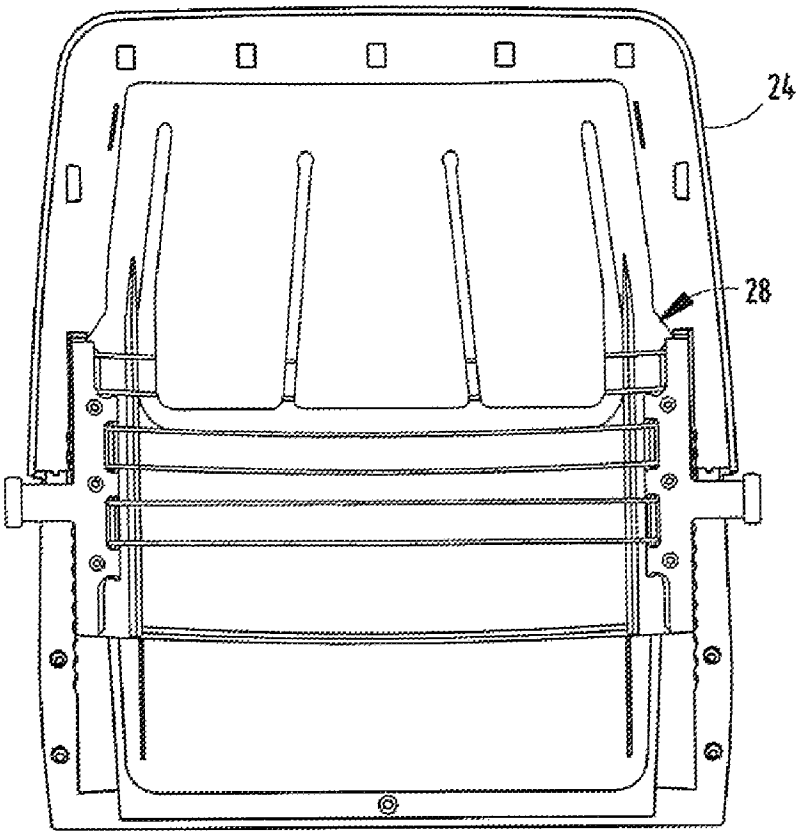
FIG. 35 is a front elevational view of the back support and lumbar assembly.

To assemble the back construction 18, first the clip 30 is attached to the back support 24 as discussed above or alternatively, attached to the inner shell 27. Where the clip is integral with the back support or inner shell, this step is not necessary. Next, for a chair 10 including a lumber assembly 28, the lumbar assembly 28 is positioned over the back support 24 such that the wire retainers 126 and **126*a* are positioned on the ramps 72, the tabular flanges 141 abut the alignment stops 64, and the tabs 146 on the wire retainers are slidably engaged with the wave ridges 66 on the back support 24. (FIGS. 35 and 26). Alternatively, the lumbar assembly can be positioned over the back support first and then the clips attached to the back support. If the chair 10 does not include a lumbar assembly 28**, this step is not necessary.

Figure 36:
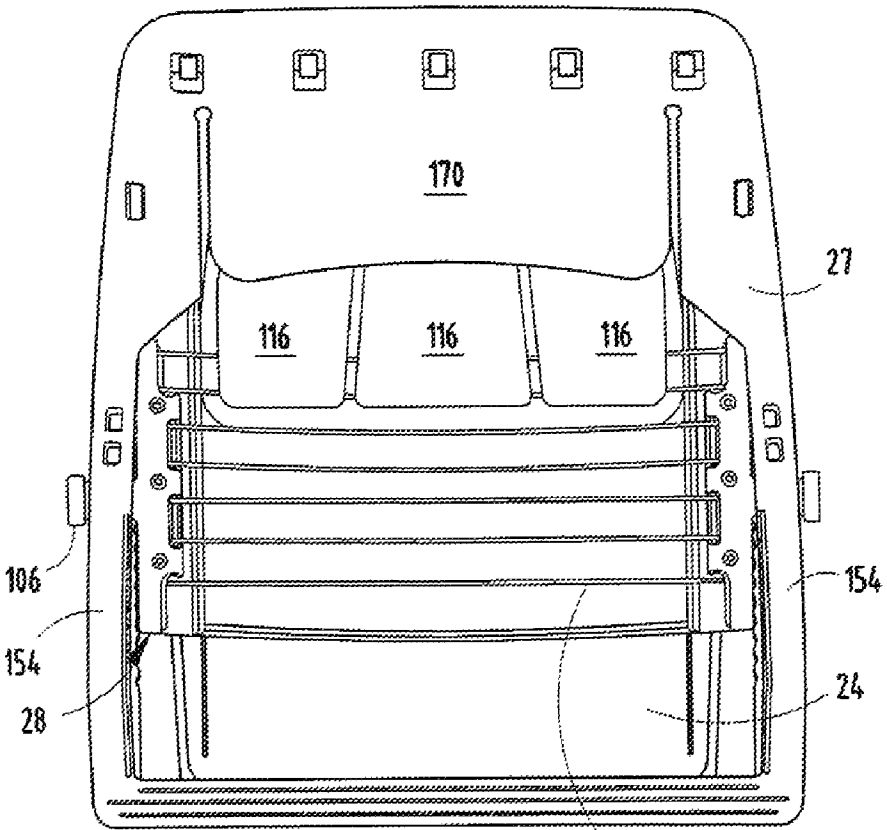
FIG. 36 is a front elevational view of the back support, lumbar assembly, and inner shell.
Figure 38:
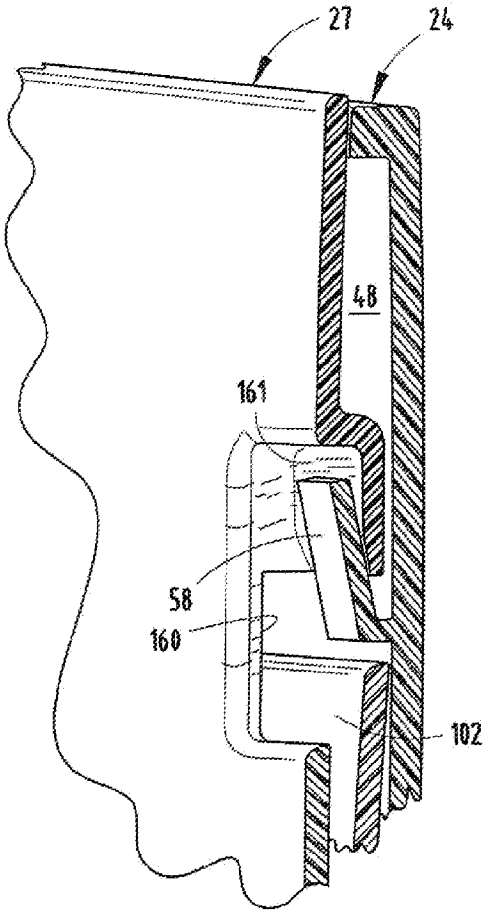
FIGS. 37 and 38 are exploded fragmentary views showing the top section of the inner shell including an aperture and the upper section of the back support including a hook.

Next, the cushion assembly 26 including the inner shell 27 is positioned above the back support 24 and optionally, the lumbar assembly 28. (FIG. 36). By moving the cushion assembly 26 downward over the back support 24, the hooks 174 slide through the clips 30. (FIG. 31). In particular, a lower hook 174 of the inner shell 27 passes through the angled edge 180 and the uppermost angled ramp 186 of the clip 30 until the lower hook reaches a stop 187. Notably, the angled edge 180 and the angled ramp 186 allow each hook 174 to slide easily through the clip 30. The stop 187 suspends forward movement of the hook 174, to allow positioning of the cushion assembly 26, back support 24, and optionally, the lumbar assembly 28. The stop 187 makes it difficult, but not impossible, for the hook to move backward to allow disassembly of the back construction, if desired. Partial assembly positioning of the hooks on the back support through the apertures on the inner shell 27 is accomplished when an associated hook 174 reaches an indentation 188. Where the inner shell 27 includes two apertures 172 and hooks 174, assembly of the back construction includes three stages. Once the cushion assembly, back support, and optionally, the lumbar assembly are positioned as desired (first stage), application of additional downward force will cause the hook 174 to pass through the stop 187 to reach the indentation 188. As each hook 174 slides through the upholstery attachment clip 30, the assembler is able to first place hooks 60 located on the upper left and upper light portions of the back support 24 through apertures 166 located on the upper left and upper right portions of the inner shell 27 (second stage) and then place hooks 58 across the top of the back support through apertures 160 across the top of the inner shell (third stage). (FIGS. 37, 38). Forward movement of the hooks 174 is finally stopped when the end portion 190 of the clip 30 is reached. As the number of hooks 174 increases, the possible number of assembly stages also increases. Where the clip 30 is attached to, or integral with, the inner shell 27 and the back support includes the more than two apertures 172 and hooks 174, assembly of the back construction 18 is similar to that discussed above.

Referring to FIGS. 39-43, the base 12 includes a center hub 193, a leg assembly 19 having a plurality of radially extending legs 196, and a leg cover 198 adapted to cover the legs 196 inside the center hub 193 is a cylinder 192, which is attached to a control housing 20. The legs 196 include a vertical tube section 200 at the leg outer end 202 for receiving a pintle 204 of a caster 206. The leg outer end 202 has a concave shape to mateably engage tire vertical tube section 200, thereby partially encircling the vertical tube section 200. In a preferred embodiment, the vertical tube section 200 is welded to the leg outer end 202. The legs 196 also each have a top surface 208 divided by a weld along its centerline 210 and have an aperture 212 offset to one side of the centerline 210 near the leg outer end 202 of the respective legs.

The apertures 212 (FIG. 42) have an oblong shape, and each side includes two tines 213 that extend about one-third to one-half of the way into the aperture 212. The tines 213 on each side are spaced apart so that they define a space for receiving a respective boss 217, but so that the fines 213 frictionally engage the sides of the boss 217 to prevent its removal. By locating the apertures 212 offset to one side of the tubular section of legs 196, the complete apertures 212 can be preformed in the sheet metal before forming the tube, and therefore the apertures 212 can be more accurately formed. Also, the weld line in the tube does not have to skip or avoid the apertures 212. Also, the weld line can be located in a symmetrical location on the tubular section, so that the forming and welding processes for forming the tubular legs 196 are more consistent and controllable. The leg cover 198 includes reinforcement ribs 214 that stiffen side flanges 216 of the leg cover 198.

Figure 44:
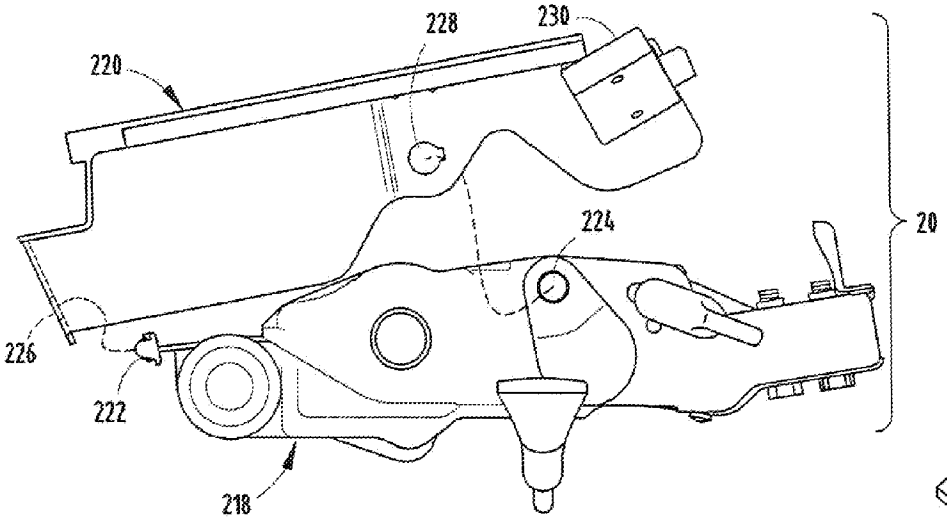
FIG. 44 is an exploded right side elevational view of the control housing shown in FIG. 2.

As shown in FIGS. 44 and 45, the control housing 20 includes a primary energy mechanism 218 and a top plate 220. The primary energy mechanism 218 is similar to that disclosed in co-assigned U.S. Pat. No. 6,991,291, filed Feb. 1, 2005, entitled "BACK CONSTRUCTION FOR SEATING UNIT HAVING SPRING BIAS," the contents of which are incorporated herein by reference for its teachings. The mechanism 218 includes an elongated horizontal tab 222 across the front of the mechanism 218 and a pin 224 on each side of the mechanism. The top plate 220 includes a slit 226 across the front of the plate 220. On each side of the top plate 220 is an aperture 228 and a fixed side support 230 to which the armrest 22 is attached. To attach the top plate 220 to the primary energy mechanism 218, the horizontal tab 222 is inserted into slit 226. The top plate 220 is then pivoted such that the aperture 228 on the top plate is aligned with the pin 224 on the mechanism. The pin is then inserted through the aperture.

It is to be understood, that variations and modifications can be made on the aforementioned structure without departing from the concepts of the present invention and further it is to be understood that such concepts are intended to be covered by the following claims unless these claims by their language expressly state otherwise.

The invention claimed is:

1. A chair back construction comprising:

an outer shell;

a lumbar assembly positioned over the outer shell and including a lumbar frame including a transition shell having an upper edge and a lower edge, and a vertically sliding live lumbar device having a plurality of horizontal flexible wires, where the transition shell lower edge is positioned on top of an uppermost horizontal flexible wire of the lumbar device; and a cushion assembly positioned over the lumbar assembly and attached to the outer shell;

wherein the lumbar device is operably slidably mounted between the outer shell and the cushion assembly, and the transition shell upper edge slides between the outer shell and the upholstery cushion assembly.

2. The chair back according to claim 1, wherein the transition shell further includes slits extending from near a transition shell upper edge to a lower edge which form vertical strips.

3. The chair back according to claim 1, wherein the lumbar frame further comprises a lumbar device support including a first vertical flange projecting outwardly and a second vertical flange which is approximately perpendicular to the first vertical flange.

4. The chair according to claim 3, wherein the second vertical flange further comprises handles for vertically adjusting the lumbar frame and fastening apertures for attaching the lumbar device to the lumbar device support.

5. The chair according to claim 3, wherein the lumbar device support further comprises openings located where the first and second flanges intersect.

6. A lumbar device comprising:

a first and a second wire retainer, each retainer including a convex front surface having a plurality of wells, an outside surface including oppositional tabs for slidably engaging a wave ridge of a back support to hold the lumbar device in a selected position, and a rear surface shaped to slidably engage a front surface of the back support; and a plurality of flexible wires positioned in the wells and held in a horizontal position, wherein the wires slightly bend when placed in the wire retainers, and wherein the plurality of flexible wires generally define a curved surface substantially corresponding to the convex front surface of the wire retainers.

7. The lumber device according to claim 6, wherein the length of the flexible wires is greater than a distance between the pair of wire retainers.

8. The lumbar device according to claim 6, wherein the wells each include a pair of horizontal wires.

9. The lumbar device according to claim 8, wherein the pair of horizontal wires is formed using a single wire bent into a rectangle having a first end and a second end, with the first end of the rectangle including the two ends of the single wire.

10. The lumbar device according to claim 9, wherein the first end of the rectangle is positioned in a well of the first wire retainer, and the second end is positioned in a well of the second retainer.

11. The lumber device according to claim 8, wherein the pair of horizontal wires comprise two single wires.

12. A lumbar device comprising:

a first and a second wire retainer, each retainer including a convex front surface having a plurality of wells, an outside surface including oppositional tabs for slidably engaging a wave ridge of a back support to hold the lumbar device in a selected position, and a rear surface shaped to slidably engage a front surface of the back support; and a plurality of flexible wires positioned in the wells and held in a horizontal position, wherein the wires slightly bend when placed in the wire retainers, and wherein the plurality of flexible wires generally define a curved surface, wherein the front surface of the back support further includes a ramp, and wherein the rear surface and the ramp are concentric such that the lumbar device remains engaged with the ramp when the lumbar device is vertically adjusted.

13. The lumbar device according to claim 12, wherein the rear surface further includes at least one tabular flange, and the front surface of the back support further includes an alignment stop, wherein the at least one tabular flange abuts the alignment stop.

* * * * *

UNITED STATES PATENT AND TRADEMARK OFFICE

CERTIFICATE OF CORRECTION

PATENT NO. : 7,857,388 B2
APPLICATION NO. : 11/757138
DATED : December 28, 2010
INVENTOR(S) : Bedford et al.

It is certified that error appears in the above-identified patent and that said Letters Patent is hereby corrected as shown below:

Column 1
Line 11, "filed one even data herewith," should be -- June 1, 2007 --.
Line 35, "solves" should be -- solve --.
Line 61, "are" should be -- is --.
Line 62, "form" should be -- forms --.

Column 2
Line 11, "back, support" should be -- back support --.

Column 3
Lines 23-24, "across XXXIV-XXXIV" should be -- across the line XXXIV-XXXIV --.

Column 5
Line 51, "hack" should be -- back --.

Column 6
Line 31, "are" should be -- is --.
Line 33, "bent, wires" should be -- bent wires --.
Line 56, "if" should be -- it --.
Line 59, "are" should be -- is --.

Column 7
Line 12, "back:support" should be -- back support --.
Line 30, "are" should be -- is --.

Column 8
Line 6, "polyethylene, and is" should be -- polyethylene, is --.
Line 31, "connect" should be -- connects --.
Lines 41-42, "include, slits" should be -- include slits --.

Signed and Sealed this
Third Day of May, 2011

David J. Kappos

David J. Kappos
*Director of the United States Patent and Trademark Office*

Column 9
Line 40, “lumber” should be -- lumbar --.

Column 10
Line 9, “light” should be -- right --.
Lines 23-23, “196 inside” should be -- 196. Inside --.
Line 28, “tire” should be -- the --.
Line 39, “fines” should be -- tines --.

Column 12
Line 10, “lumber” should be -- lumbar --.
Line 23, “lumber” should be -- lumbar --.